US011493865B2

(12) United States Patent
Kadowaki

(10) Patent No.: US 11,493,865 B2
(45) Date of Patent: Nov. 8, 2022

(54) IMAGE HEATING DEVICE AND IMAGE FORMING APPARATUS

(71) Applicant: Canon Kabushiki Kaisha, Tokyo (JP)

(72) Inventor: Hiroyuki Kadowaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/201,217

(22) Filed: Mar. 15, 2021

(65) Prior Publication Data

US 2021/0200123 A1 Jul. 1, 2021

Related U.S. Application Data

(63) Continuation of application No. PCT/JP2019/035954, filed on Sep. 12, 2019.

(30) Foreign Application Priority Data

Sep. 13, 2018 (JP) ..... JP2018-171692

(51) Int. Cl.
*G03G 15/20* (2006.01)

(52) U.S. Cl.
CPC ..... *G03G 15/205* (2013.01); *G03G 15/20* (2013.01); *G03G 15/2042* (2013.01); (Continued)

(58) Field of Classification Search
CPC .. G03G 15/205; G03G 15/20; G03G 15/2064; G03G 15/2042; G03G 15/2053; G03G 15/2039; G03G 15/5004; G03G 2215/2003; G03G 15/2046; G03G 2215/2006; G03G 2215/2035
See application file for complete search history.

(56) References Cited

U.S. PATENT DOCUMENTS 9,436,139 B2 9/2016 Kadowaki
11,199,795 B2 * 12/2021 Uchiyama ..... G03G 15/2053
(Continued)

FOREIGN PATENT DOCUMENTS

JP 04044075 A 2/1992
JP 06095540 A 4/1994
(Continued)

OTHER PUBLICATIONS

Extended European Search Report dated May 9, 2022 in counterpart European Patent Appln. No. 19860119.7.

*Primary Examiner* — Walter L Lindsay, Jr.
*Assistant Examiner* — Laura Roth
(74) *Attorney, Agent, or Firm* — Venable LLP

(57) ABSTRACT

An image heating device includes a heater having a plurality of heating elements that heat a plurality of heating regions and a control portion that controls the supply of electric power to the plurality of heating elements. The power supply is controlled so that a first average temperature, which is an average value of control target temperatures of heating regions included in a first region located closer to one end side than a central heating region in a direction orthogonal to a conveying direction of a recording material, and a second average temperature, which is an average value of control target temperatures of heating regions included in a second region located closer to the other end side than the central heating region, are within a predetermined temperature range.

12 Claims, 24 Drawing Sheets

(52) U.S. Cl.
CPC ..... *G03G 15/2046* (2013.01); *G03G 15/2053* (2013.01); *G03G 15/2064* (2013.01); *G03G 2215/2006* (2013.01)

(56) References Cited

U.S. PATENT DOCUMENTS

| | | | | |
|---|---|---|---|---|
| 2006/0062585 | A1* | 3/2006 | Sone ..... | G03G 15/2039 399/69 |
| 2006/0115305 | A1 | 6/2006 | Lofthus et al. | |
| 2015/0050038 | A1 | 2/2015 | Suganuma et al. | |
| 2015/0286174 | A1* | 10/2015 | Yamamoto ..... | G03G 15/2039 399/69 |
| 2016/0070216 | A1* | 3/2016 | Shimura ..... | G03G 15/2003 399/69 |
| 2018/0004136 | A1* | 1/2018 | Iwasaki ..... | G03G 15/2017 |
| 2018/0210380 | A1 | 7/2018 | Uchiyama et al. | |

FOREIGN PATENT DOCUMENTS

| | | | |
|---|---|---|---|
| JP | 2014059508 | A | 4/2014 |
| JP | 2018004940 | A | 1/2018 |
| JP | 2018120117 | A | 8/2018 |
| JP | 2018124476 | A | 8/2018 |

* cited by examiner

FIG.6B <CLASSIFICATION BASED ON IMAGE INFORMATION>

| | A1 | A2 | A3 | A4 | A5 | A6 | A7 |
|---|---|---|---|---|---|---|---|
| T1 | AP | AP | AI | AI | AI | AI | AP |
| T2 | AP | AP | AI | AI | AI | AI | AP |
| T3 | AP | AP | AI | AI | AI | AI | AP |
| T4 | AP | AP | AI | AI | AI | AI | AP |
| T5 | AP | AP | AI | AI | AI | AI | AP |

FIG.16B <CLASSIFICATION BASED ON IMAGE INFORMATION>

| | A1 | A2 | A3 | A4 | A5 | A6 | A7 |
|---|---|---|---|---|---|---|---|
| T1 | AP | AP | AI | AI | AI | AI | AP |
| T2 | AP | AP | AI | AI | AI | AI | AP |
| T3 | AP | AP | AI | AI | AI | AI | AP |
| T4 | AP | AP | AP | AP | AP | AP | AP |
| T5 | AP | AP | AP | AP | AP | AP | AP |

SECTION AVERAGE VALUE OF SECTIONS $T_1$ TO $T_3$

SECTION AVERAGE VALUE OF SECTIONS $T_1$ TO $T_4$

SECTION AVERAGE VALUE OF SECTIONS $T_1$ TO $T_5$

FIG.19B <CLASSIFICATION BASED ON IMAGE INFORMATION>

| | $A_1$ | $A_2$ | $A_3$ | $A_4$ | $A_5$ | $A_6$ | $A_7$ |
|---|---|---|---|---|---|---|---|
| $T_1$ | AP | AI | AI | AI | AP | AP | AP |
| $T_2$ | AP | AI | AI | AI | AP | AP | AP |
| $T_3$ | AP | AI | AI | AI | AP | AP | AP |
| $T_4$ | AP | AI | AI | AI | AP | AP | AP |
| $T_5$ | AP | AI | AI | AI | AP | AP | AP |

<CLASSIFICATION BASED ON IMAGE INFORMATION>

| | $A_1$ | $A_2$ | $A_3$ | $A_4$ | $A_5$ | $A_6$ | $A_7$ |
|---|---|---|---|---|---|---|---|
| $T_1$ | AP | AP | AI | AI | AI | AP | AP |
| $T_2$ | AP | AP | AI | AI | AI | AP | AP |
| $T_3$ | AP | AP | AI | AI | AI | AP | AP |
| $T_4$ | AP | AP | AI | AI | AI | AP | AP |
| $T_5$ | AP | AP | AI | AI | AI | AP | AP |

IMAGE HEATING DEVICE AND IMAGE FORMING APPARATUS

CROSS-REFERENCE TO RELATED APPLICATIONS

This application is a Continuation of International Patent Application No. PCT/JP2019/035954, filed Sep. 12, 2019, which claims the benefit of Japanese Patent Applications No. 2018-171692, filed Sep. 13, 2018, which is hereby incorporated by reference herein in their entirety.

BACKGROUND OF THE INVENTION

Field of the Invention

The present invention relates to an image heating device such as a fixing device mounted on an image forming apparatus such as a copying machine or a printer which uses an electrophotographic system or an electrostatic recording system or a gloss providing device that improves a gloss value of a toner image by re-heating the toner image fixed to a recording material. Further, the present invention relates to an image forming apparatus including the image heating device.

Background Art

In image heating devices such as fixing devices used in electrophotographic image forming apparatuses (hereinafter, image forming apparatuses) such as copying machines and printers, and gloss providing devices, film-heating image heating devices that are excellent in on-demand properties and power-saving are widely used (PTL 1).

The film-heating image heating device has a ceramic heater or a halogen lamp as a heating source inside a heat-resistant endless fixing film, and the fixing film and a pressure roller (a pressure member) form a pressure contact nip portion. Then, a non-fixed toner image on the recording material is heated and fixed while the recording material is being conveyed while being pinched at the nip portion.

When a small-sized recording material is continuously printed by an image forming apparatus equipped with the image heating device, a phenomenon (a non-sheet-passing-portion temperature rise) in which the temperature of a region of a nip portion, through which a recording material does not pass gradually rises in a direction (hereinafter, a longitudinal direction) orthogonal to a conveying direction of a recording material which is a direction corresponding to a longitudinal direction of a heater occurs. If the temperature of the non-sheet-passing portion becomes too high, each part in the apparatus will be damaged, and if printing is performed on a large-sized recording material while a non-sheet-passing-portion temperature rise occurs, the toner may be offset to the fixing film at a high temperature in a region of a small-sized recording material corresponding to a non-sheet-passing portion.

As one of the methods for suppressing the non-sheet-passing-portion temperature rise, a device that divides a heating range of a heater into a plurality of heat generation blocks in the longitudinal direction and switches a heat generation distribution of the heater according to the size of a recording material is proposed (PTL 2).

In such heating devices, a method of selectively heating an image portion formed on a recording material is also proposed (PTL 3). In this method, each heat generation block is selectively controlled according to the presence of an image on the recording material, and the energization of the heat generation block is reduced in a portion where there is no image on the recording material (hereinafter, a non-image portion) to achieve power-saving.

In an image heating device as in PTL 3, when an image is formed to be biased to one side in the longitudinal direction of the recording material, since only the image portion is selectively heated, the temperature of the pressure roller in an image portion is higher than that in a non-image portion, and a lateral difference occurs in the longitudinal temperature distribution of the pressure roller. This lateral temperature difference is the difference in thermal expansion of an elastic layer of the pressure roller, and the outer diameter of the pressure roller in the image portion is larger than that in the non-image portion. Therefore, a lateral difference occurs in the feed amount of the fixing film by the pressure roller (the amount of movement of the fixing film followed by the pressure roller), and the feed amount of the image portion is larger than the feed amount of the non-image portion. Due to this difference in the feed amount of the fixing film, the fixing film on the side with the larger feed amount is pushed to the downstream side, and an intersection angle is generated between the generatrix of the pressure roller and the generatrix of the film. As a result, a transversely moving force is generated such that the fixing film tends to move to the side where the feed amount of the fixing film is large. Due to this transversely moving force, leaning movement of the film occurs, the end of the fixing film on the image portion side is pressed against a regulating member (hereinafter, a fixing flange) on that side, and the end surface of the fixing film receives a load. If the end surface of the fixing film continuously receives such a load, the life of the image heating device may be shortened due to damage to the fixing film such as scraping of the end of the fixing film.

In addition to this, when an image is formed to be biased to the central portion in the longitudinal direction of a recording material, the temperature of the pressure roller in the central portion with the image is higher than that on both ends without the image. Therefore, on the basis of the same principle as described above, the feed amount of the fixing film by the pressure roller in the central portion is larger than that in both ends. Due to this difference in the feed amount of the fixing film, the central portion of the fixing film is pushed to the downstream side in the conveying direction than both ends, and the fixing film is deformed into a bow shape. As a result, a transversely moving force toward the center from both ends of the fixing film (hereinafter, a centering force) is generated, and a load is generated on the fixing film. When the fixing film continuously receives the load due to the centering force, damage to the fixing film may occur due to the wrinkles generated in the central portion of the fixing film, which may shorten the life of the image heating device.

On the other hand, in the image heating device as in PTL 1, since the heater is heated so that the temperature distribution in the longitudinal direction is flat, it is possible to suppress the above-described shortening of the life of the image heating device. However, since the heater uniformly heats a recording material regardless of the presence of an image on the recording material, the portion without the image on the recording material is heated, which consumes extra power.

An object of the present invention is to provide a technique capable of achieving both power-saving and long life in an image heating device.

CITATION LIST

Patent Literature

PTL 1 Japanese Patent Application Publication No. H04-44075

PTL 2 Japanese Patent Application Publication No. 2014-59508

PTL 3 Japanese Patent Application Publication No. H06-95540

SUMMARY OF THE INVENTION

In order to attain the object, an image heating device according to the present invention includes: a heater having a plurality of heating elements arranged in a direction orthogonal to a conveying direction of a recording material; a control portion that controls temperatures of a plurality of heating regions heated by the plurality of heating elements individually by controlling electric power to be supplied to the plurality of heating elements individually; and an acquisition portion that acquires information on an image to be formed on the recording material, wherein the image formed on the recording material is heated by the heat of the heater, and the control portion controls the supply of electric power to the plurality of heating elements so that a first average temperature which is an average value of control target temperatures of heating regions included in a first region located closer to one end side than a central heating region in a direction orthogonal to the conveying direction among the plurality of heating regions and a second average temperature which is an average value of control target temperatures of heating regions included in a second region located closer to the other end side than the central heating region are within a predetermined temperature range.

In order to attain the object, an image heating device according to the present invention includes: a heater having a plurality of heating elements arranged in a direction orthogonal to a conveying direction of a recording material; a control portion that controls temperatures of a plurality of heating regions heated by the plurality of heating elements individually by controlling electric power to be supplied to the plurality of heating elements individually; and an acquisition portion that acquires information on an image to be formed on the recording material, wherein the image formed on the recording material is heated by the heat of the heater, and the control portion controls the supply of electric power to the plurality of heating elements so that: when an average value of control target temperatures of heating regions included in a first region located closer to one end side than a central heating region in a direction orthogonal to the conveying direction among the plurality of heating regions is a first average temperature, an average value of control target temperatures of heating regions included in a second region located closer to the other end side than the central heating region is a second average temperature, and an average value of control target temperatures of heating regions included in a third region between the first region and the second region, including at least the central heating region is a third average temperature, relationships that the third average temperature is equal to or higher than the first average temperature and the third average temperature is equal to or higher than the second average temperature are satisfied, and a sum of a difference between the first average temperature and the third average temperature and a difference between the second average temperature and the third average temperature is smaller than a predetermined threshold value.

In order to attain the object, an image forming apparatus according to the present invention includes: an image forming portion that forms an image on a recording material; and a fixing portion that fixes the image formed on the recording material to the recording material, wherein the fixing portion is the image heating device according to the present invention.

Further features of the present invention will become apparent from the following description of exemplary embodiments with reference to the attached drawings.

BRIEF DESCRIPTION OF THE DRAWINGS

FIGS. 6A and 6B are specific examples related to the classification of the heating region of the first embodiment.

FIGS. 16A to 16E are specific examples related to the classification of the heating region of a second embodiment.

FIGS. 19A to 19C are diagrams showing the positions of a heating region, a recording material, and an image forming region in a third embodiment.

DESCRIPTION OF THE EMBODIMENTS

Hereinafter, modes for carrying out the present invention will be described in detail on the basis of exemplary embodiments with reference to the drawings. Dimensions, materials, shapes, relative arrangements, and the like of components disclosed in the embodiment are to be changed appropriately depending various conditions and a configuration of an apparatus to which the present invention is applied. That is, the scope of the present invention is not limited to the following embodiments.

First Embodiment

Figure 1:
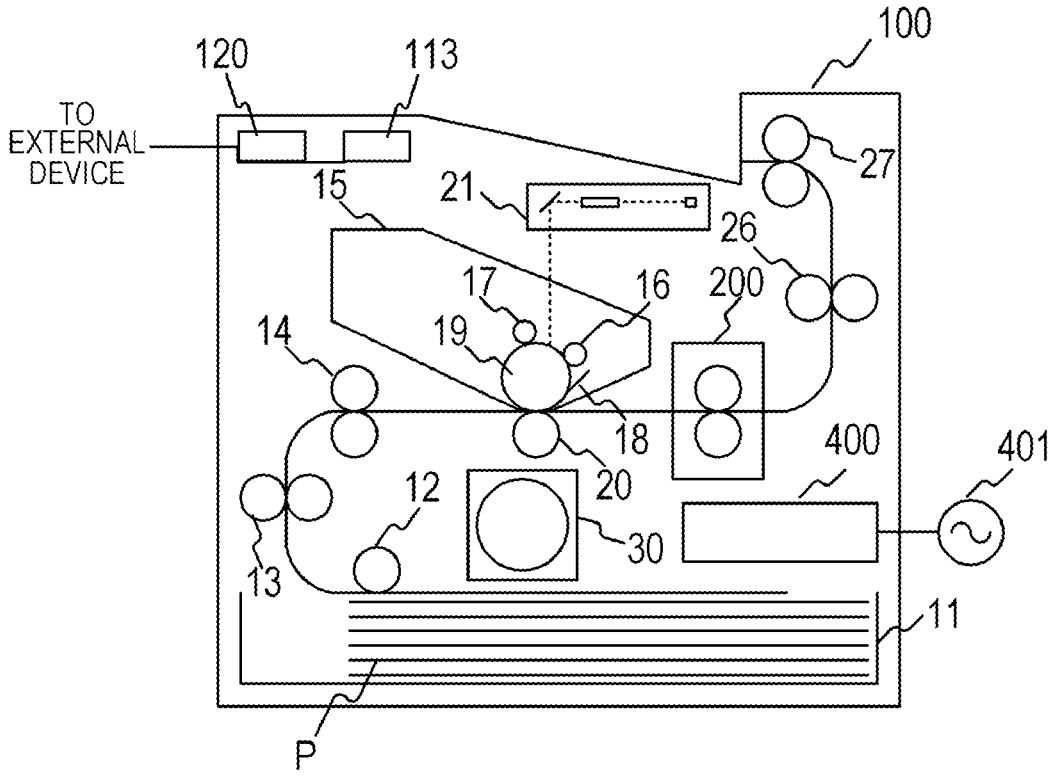
FIG. 1 is a cross-sectional view of an image forming apparatus.

FIG. 1 is a schematic cross-sectional view of an image forming apparatus according to an embodiment of the present invention. Examples of the image forming apparatus to which the present invention can be applied include a copying machine and a printer which use an electrophotographic system and an electrostatic recording system. In the present embodiment, a case where the present invention is applied to a laser printer will be described.

An image forming apparatus 100 includes a video controller 120 and a control portion 113. The video controller 120 receives and processes image information and print instructions transmitted from an external device such as a personal computer as an acquisition portion for acquiring information on an image formed on a recording material. The control portion 113 is connected to the video controller 120 and controls each unit constituting the image forming apparatus 100 in response to an instruction from the video controller 120. When the video controller 120 receives a print instruction from an external device, printing is executed by the following operations.

When a print signal is generated, a scanner unit 21 emits a laser beam modulated according to the image information, and a charging roller 16 scans the surface of a photosensitive drum 19 charged with a predetermined polarity. As a result, an electrostatic latent image is formed on the photosensitive drum 19. When toner is supplied from the developing roller 17 to the electrostatic latent image, the electrostatic latent image on the photosensitive drum 19 is developed as a toner image. On the other hand, a recording material (recording sheet) P loaded on a sheet feed cassette 11 is fed one by one by a pickup roller 12, and is conveyed toward a registration roller pair 14 by a conveying roller pair 13. Further, the recording material P is conveyed from the registration roller pair 14 to a transfer position at the timing when the toner image on the photosensitive drum 19 reaches the transfer position formed by the photosensitive drum 19 and the transfer roller 20. The toner image on the photosensitive drum 19 is transferred to the recording material P in the process in which the recording material P passes through the transfer position. After that, the recording material P is heated by a fixing device (an image heating device) 200 as a fixing portion (an image heating portion), and the toner image is heated and fixed to the recording material P. The recording material P that bears the fixed toner image is discharged to a tray above-described the image forming apparatus 100 by conveying roller pairs 26 and 27.

The image forming apparatus 100 further includes a drum cleaner 18 for cleaning the photosensitive drum 19 and a motor 30 for driving the fixing device 200 and the like. A control circuit 400 as a heater driving unit connected to a commercial AC power supply 401 supplies electric power to the fixing device 200. The photosensitive drum 19, the charging roller 16, the scanner unit 21, the developing roller 17, and the transfer roller 20 form an image forming portion for forming a non-fixed image on the recording material P. Further, in the present embodiment, a developing unit including the charging roller 16 and the developing roller 17 and a cleaning unit including the photosensitive drum 19 and the drum cleaner 18 are configured to be detachably attached to the main body of the image forming apparatus 100 as a process cartridge 15.

In the image forming apparatus 100 of the present embodiment, the maximum sheet passing width in the direction orthogonal to the conveying direction of the recording material P is 216 mm, and a plain sheet of the LETTER size (216 mm×279 mm) can be printed at a printing speed of 35 sheets per minute at a conveying speed of 232.5 mm/sec.

Figure 2A:
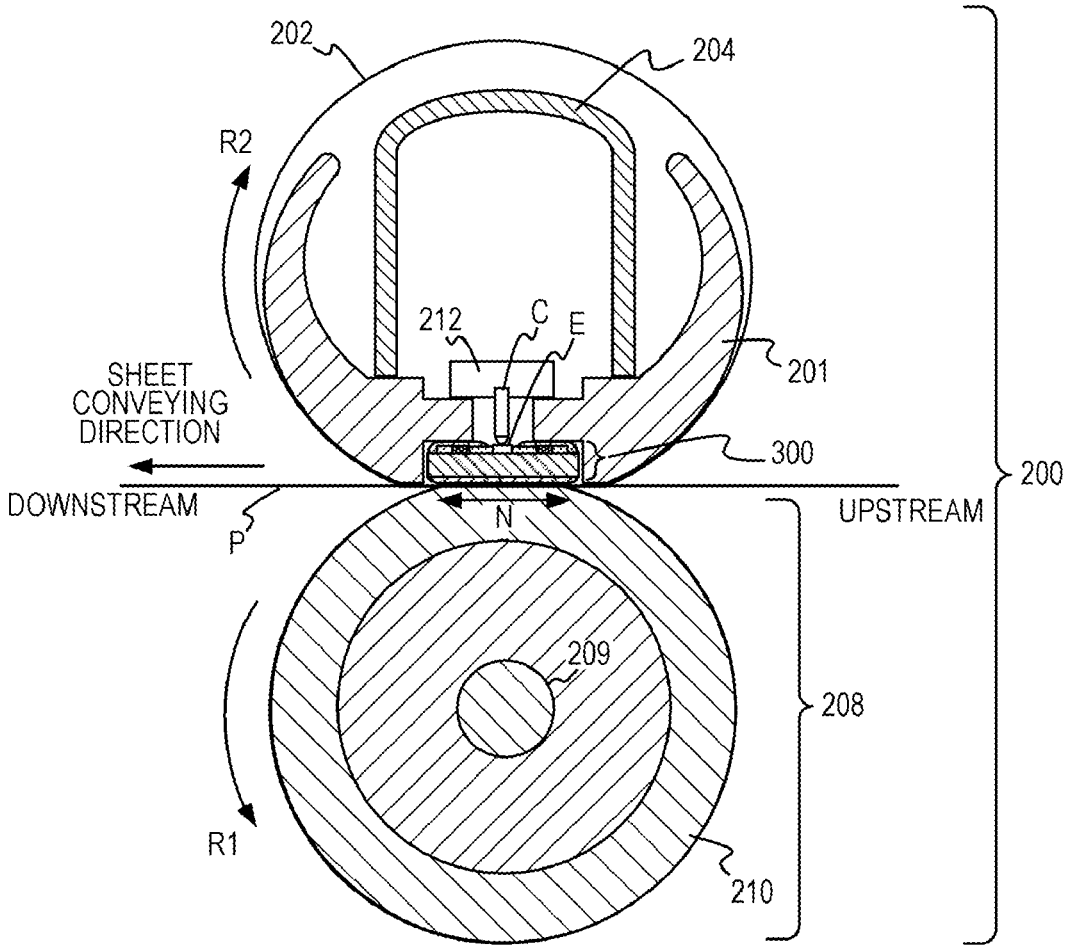
FIGS. 2A and 2B are cross-sectional views of the image heating device of the first embodiment.

FIG. 2A is a schematic cross-sectional view of the fixing device 200. The fixing device 200 includes a fixing film 202, a heater 300 that contacts the inner surface of the fixing film 202, a pressure roller 208 that forms a fixing nip portion N together with the heater 300 with the fixing film 202 interposed therebetween, and a metal stay 204.

The fixing film 202 is a multi-layer heat-resistant film formed in a tubular shape, and is made of a heat-resistant resin such as polyimide or a metal such as stainless steel as a base layer. Further, in order to prevent adhesion of toner and ensure separability from the recording material P, a release layer is formed on the surface of the fixing film 202 by coating with a heat-resistant resin having excellent releasability such as tetrafluoroethylene-perfluoroalkyl vinyl ether copolymer (PFA). Further, in order to improve the image quality, a heat-resistant rubber such as silicone rubber may be formed between the base layer and the release layer as an elastic layer. The pressure roller 208 has a core metal 209 made of a material such as iron or aluminum and an elastic layer 210 made of a material such as silicone rubber. The heater 300 is held by a heater holding member 201 made of heat-resistant resin, and heats the fixing film 202 by heating the heating regions $A_1$ to $A_7$ (details will be described later) provided in a fixing nip portion N. The heater holding member 201 also has a guide function for guiding the rotation of the fixing film 202. The heater 300 is provided with an electrode E on the side (back surface side) opposite to the side in contact with the inner surface of the fixing film 202, and power is supplied to the electrode E by an electrical contact C. The metal stay 204 receives a pressing force (not shown) and urges the heater holding member 201 toward the pressure roller 208. Further, safety elements 212 such as a thermo switch and a temperature fuse that operate due to abnormal heating of the heater 300 to cut off the electric power supplied to the heater 300 are arranged to face the back surface side of the heater 300.

The pressure roller 208 rotates in the direction of arrow R1 in response to power from the motor 30. As the pressure roller 208 rotates, a rotational force acts on the fixing film 202 due to the frictional force between the pressure roller 208 and the outer surface of the fixing film 202, and the fixing film 202 rotates in the direction of arrow R2 following the rotation of the pressure roller 208. The heat of the fixing film 202 is applied to the recording material P which is conveyed in a state of being pinched at the fixing nip portion N, whereby a non-fixed toner image on the recording material P is fixed. Further, in order to secure the slidability of the fixing film 202 and obtain a stable driven rotation state, a fluorine-based lubricating grease (not shown) having high heat resistance is interposed between the heater 300 and the fixing film 202.

Figure 2B:
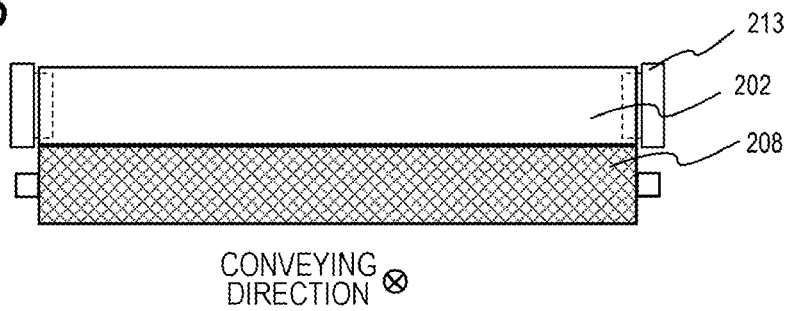

FIG. 2B is a diagram of the fixing device 200 as viewed from a direction parallel to the conveying direction of the recording material. The fixing film 202 may move and lean to the left or right in the longitudinal direction, and fixing flanges 213 (regulating members) for restricting the leaning are provided at both ends of the fixing film 202. When leaning occurs in the fixing film 202, a fixing film end surface moves and leans to abut against the end surface facing portion of the fixing flange 213 whereby leaning is restricted. Further, the fixing flange 213 has an inner surface facing portion facing the inner surface of the end of the fixing film 202. A slight clearance is provided between the inner surface of the fixing film 202 and the inner surface facing portion, and the inner surface facing portion also has a function of guiding the inner surface of the fixing film 202 when the fixing film rotates.

Figure 3A:
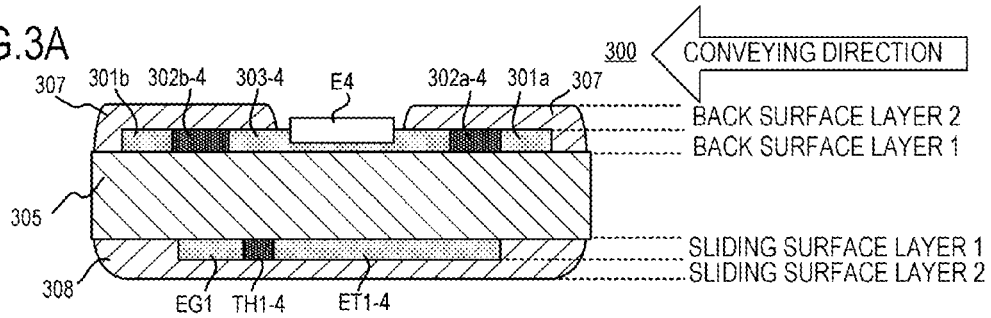
FIGS. 3A to 3C are heater configuration diagrams of the first embodiment.
Figure 3B:
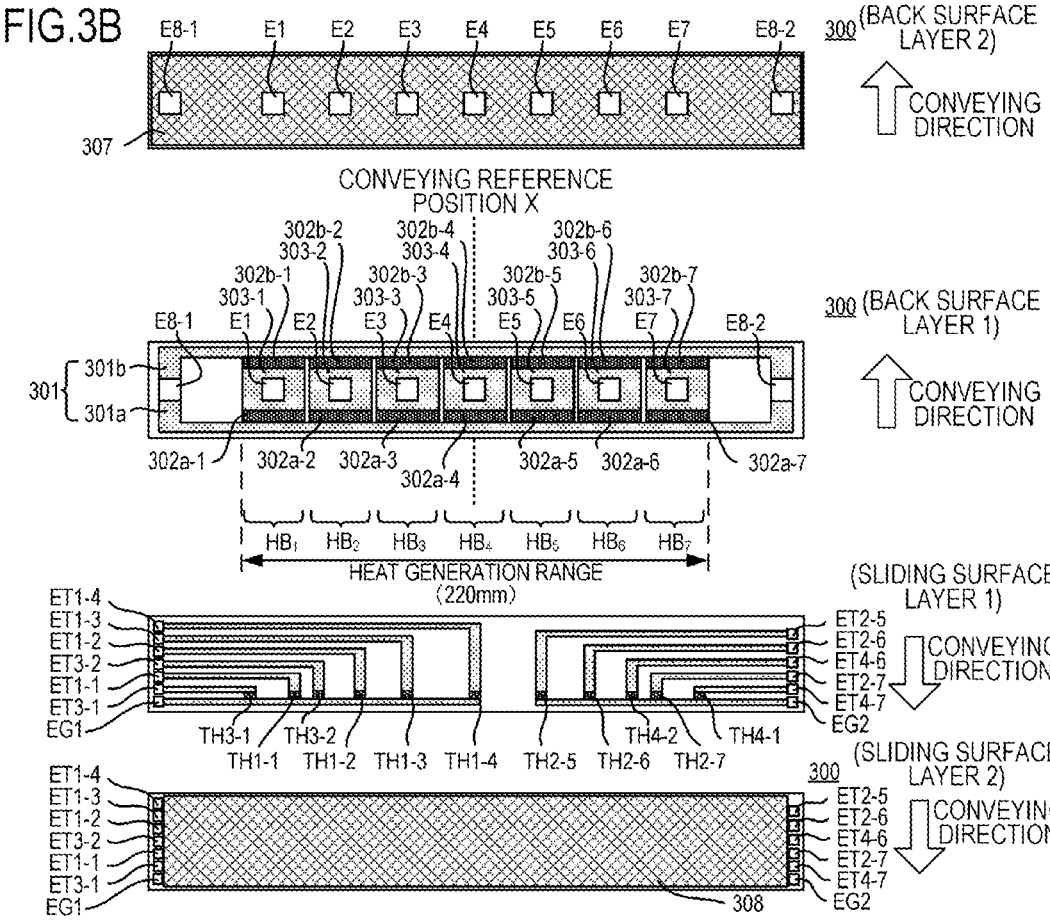
Figure 3C:
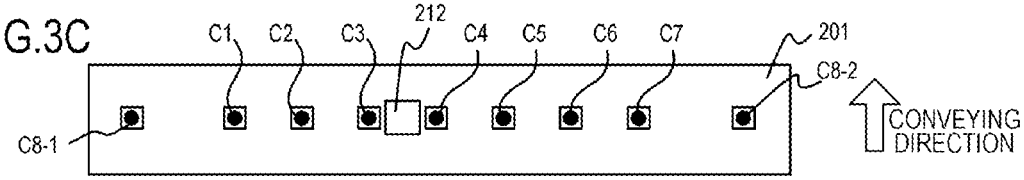

The configuration of the heater 300 of the present embodiment will be described with reference to FIGS. 3A to 3C. FIG. 3A is a cross-sectional view of the heater 300, FIG. 3B is a plan view of each layer of the heater 300, and FIG. 3C is a diagram illustrating a method of connecting the electric contact C to the heater 300. FIG. 3B shows a conveying reference position X of the recording material P in the image forming apparatus 100 of the present embodiment. The conveying reference in the present embodiment is the center reference, and the recording material P is conveyed so that the center line passing through the center in the direction orthogonal to the conveying direction is along the conveying reference position X. Further, FIG. 3A is a cross-sectional view of the heater 300 at the conveying reference position X.

The heater 300 includes a ceramic substrate 305, a back surface layer 1 provided on the substrate 305, a back surface layer 2 covering the back surface layer 1, a sliding surface layer 1 provided on a surface of the substrate 305 opposite to the back surface layer 1, and a sliding surface layer 2 that covers the sliding surface layer 1.

The back surface layer 1 has conductors 301 (301*a*, 301*b*) provided along the longitudinal direction of the heater 300. The conductor 301 is separated into the conductors 301*a* and 301*b*, and the conductor 301*b* is arranged on the downstream side of the conductor 301*a* in the conveying direction of the recording material P. Further, the back surface layer 1 has conductors 303 (303-1 to 303-7) provided in parallel with the conductors 301*a* and 301*b*. The conductor 303 is provided between the conductor 301*a* and the conductor 301*b* along the longitudinal direction of the heater 300.

Further, the back surface layer 1 has heating elements 302*a* (302*a*-1 to 302*a*-7) and heating elements 302*b* (302*b*-1 to 302*b*-7), which are heating resistors that generate heat when energized. The heating element 302*a* is provided between the conductor 301*a* and the conductor 303, and generates heat by supplying electric power via the conductor 301*a* and the conductor 303. The heating element 302*b* is provided between the conductor 301*b* and the conductor 303, and generates electric power by supplying electric power via the conductor 301*b* and the conductor 303.

The heating portion composed of the conductor 301, the conductor 303, the heating element 302*a*, and the heating element 302*b* is divided into seven heat generation blocks ($HB_1$ to $HB_7$) in the longitudinal direction of the heater 300. That is, the heating element 302*a* is divided into seven regions of heating elements 302*a*-1 to 302*a*-7 with respect to the longitudinal direction of the heater 300. Further, the heating element 302*b* is divided into seven regions of heating elements 302*b*-1 to 302*b*-7 with respect to the longitudinal direction of the heater 300. Further, the conductor 303 is divided into seven regions of the conductors 303-1 to 303-7 according to the division positions of the heating elements 302*a* and 302*b*. The amounts of heat generated by the seven heat generation blocks ($HB_1$ to $HB_7$) are individually controlled in such a way that the amounts of electric power supplied to the heating elements in each block are controlled individually.

The heating range of the present embodiment is the range from the left end of the heat generation block $HB_1$ in the drawing to the right end of the heat generation block $HB_7$ in the drawing, and the total length thereof is 220 mm. Further, although the lengths of each heat generation block in the longitudinal direction are the same as approximately 31 mm, the lengths may be different.

The back surface layer 1 has electrodes E (E1 to E7, and E8-1, E8-2). The electrodes E1 to E7 are provided in the regions of the conductors 303-1 to 303-7, respectively, and are electrodes for supplying electric power to the heat generation blocks $HB_1$ to $HB_7$ via the conductors 303-1 to 303-7, respectively. The electrodes E8-1 and E8-2 are provided at the longitudinal end of the heater 300 so as to be connected to the conductor 301, and are electrodes for supplying electric power to the heat generation blocks $HB_1$ to $HB_7$ via the conductor 301. In the present embodiment, the electrodes E8-1 and E8-2 are provided at both ends in the longitudinal direction of the heater 300, but for example, a configuration in which only the electrode E8-1 is provided on one side (that is, a configuration in which the electrode E8-2 is not provided) may be adopted. Further, although electric power is supplied to the conductors 301*a* and 301*b* with a common electrode, individual electrodes may be provided for each of the conductors 301*a* and 301*b* to supply electric power to each of them.

The back surface layer 2 is formed of a surface protective layer 307 having an insulating property (the back surface layer is formed of glass in the present embodiment), and covers the conductor 301, the conductor 303, and the heating elements 302*a* and 302*b*. Further, the surface protective layer 307 is formed in a region except the portion of the electrode E so that the electric contact C can be connected to the electrode E from the back surface layer 2 of the heater.

The sliding surface layer 1 is provided on the surface of the substrate 305 opposite to the surface on which the back surface layer 1 is provided. The sliding surface layer 1 has thermistors TH (TH1-1 to TH1-4, TH2-5 to TH2-7, TH3-1, TH3-2, TH4-1, TH4-2) as a detection unit for detecting the temperature of the heat generation blocks $HB_1$ to $HB_7$. The thermistors TH are formed of a material having PTC characteristics or NTC characteristics (the thermistors have NTC characteristics in the present embodiment), and the temperatures of all heat generation blocks can be detected by detecting the resistance values thereof.

Since the sliding surface layer 1 has conductors ET (ET1-1 to ET1-4, ET2-5 to ET2-7, ET3-1, ET3-2, ET4-1, ET4-2) and conductors EG (EG1, EG2) in order to energize the thermistor TH and detect the resistance values thereof. The conductors ET1-1 to ET1-4 are connected to the thermistors TH1-1 to TH1-4, respectively. The conductors ET2-5 to ET2-7 are connected to the thermistors TH2-5 to TH2-7, respectively. The conductors ET3-1 and ET3-2 are connected to the thermistors TH3-1 and TH3-2, respectively. The conductors ET4-1 and ET4-2 are connected to the thermistors TH4-1 and TH4-2, respectively. The conductor EG1 is connected to six thermistors TH1-1 to TH1-4 and TH3-1 to TH3-2 to form a common conductive path. The conductor EG2 is connected to five thermistors TH2-5 to TH2-7 and TH4-1 to TH4-2 to form a common conductive path. Each of the conductor ET and the conductor EG is formed up to the longitudinal end along the longitudinal direction of the heater 300, and is connected to a control circuit 400 at the heater longitudinal end via an electric contact (not shown).

The sliding surface layer 2 is formed of a surface protective layer 308 having slidability and insulating properties (the sliding surface layer is formed of glass in the present embodiment), covers the thermistor TH, the conductor ET, and the conductor EG, and ensures the slidability on the inner surface of the fixing film 202. Further, the surface protective layer 308 is formed in a region except both longitudinal ends of the heater 300 in order to provide electrical contacts to the conductor ET and the conductor EG.

Next, a method of connecting the electrical contact C to each electrode E will be described. FIG. 3C is a plan view of the state in which the electric contact C is connected to each electrode E as viewed from the heater holding member 201. The heater holding member 201 is provided with a through-hole at a position corresponding to the electrodes E (E1 to E7, and E8-1, E8-2). At each through-hole position, the electrical contacts C (C1 to C7, and C8-1, C8-2) are electrically connected to the electrodes E (E1 to E7, and E8-1, E8-2) by a method such as spring-based biasing or welding. The electrical contact C is connected to the control circuit 400 of the heater 300, which will be described later, via a conductive material (not shown) provided between the metal stay 204 and the heater holding member 201.

Figure 4:
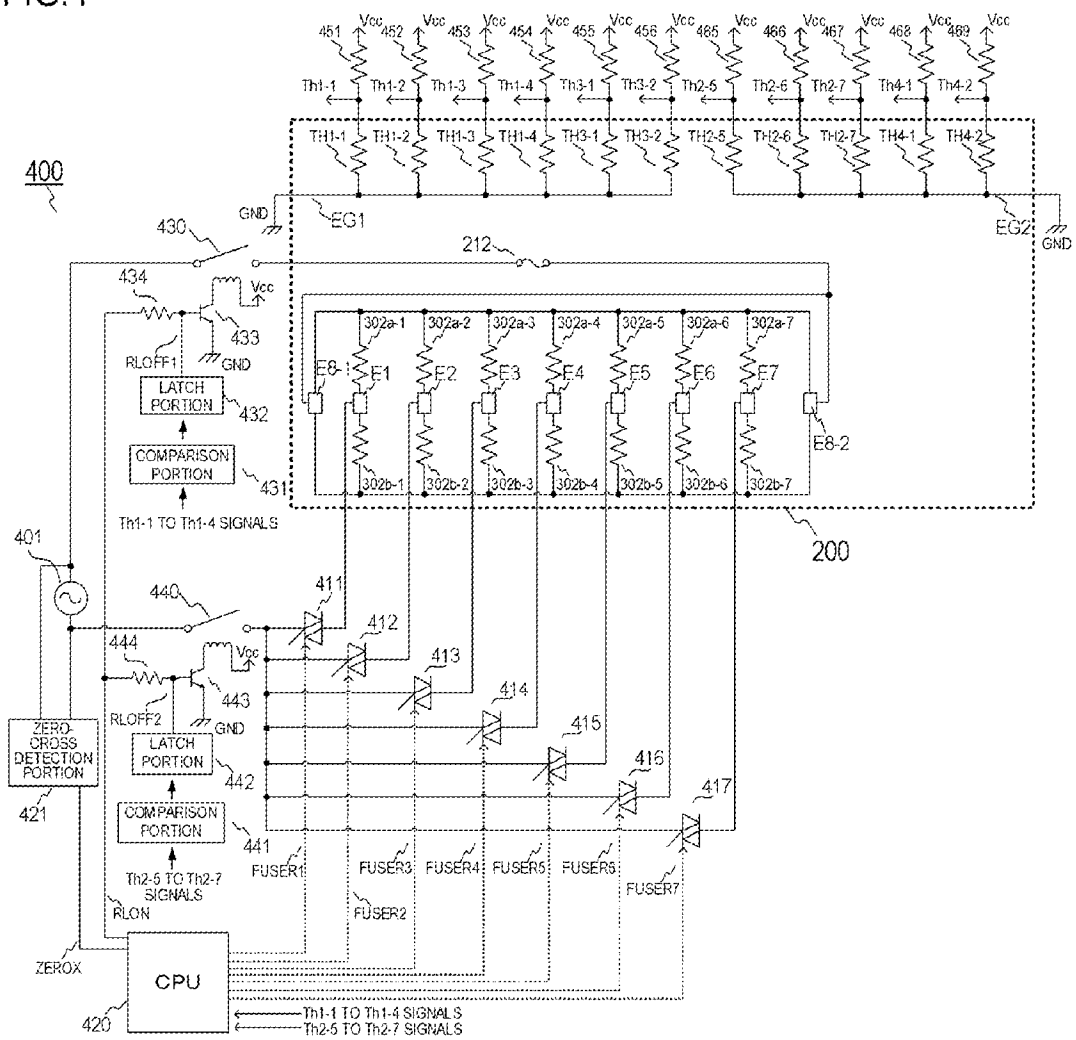
FIG. 4 is a heater control circuit diagram of the first embodiment.

FIG. 4 is a circuit diagram of the control circuit 400 of the heater 300 of the first embodiment. Reference numeral 401 denotes a commercial AC power supply connected to the image forming apparatus 100. The power control of the heater 300 is performed by energizing/de-energizing triacs 411 to 417. The triacs 411 to 417 operate according to the FUSER1 to FUSER7 signals from the CPU 420, respectively. The drive circuits of the triacs 411 to 417 are omitted. The control circuit 400 of the heater 300 has a circuit configuration capable of independently controlling the seven heat generation blocks $HB_1$ to $HB_7$ using the seven triacs 411 to 417. A zero-cross detection portion 421 is a circuit that detects the zero-cross of the AC power supply 401, and outputs a ZEROX signal to the CPU 420. The ZEROX signal is used for detecting the timing of phase control and wave number control of the triacs 411 to 417.

The temperature detection method of the heater 300 will be described. The temperature detection of the heater 300 is performed by the thermistors TH (TH1-1 to TH1-4, TH2-5 to TH2-7, TH3-1, TH3-2, TH4-1, TH4-2). The partial voltages between the thermistors TH1-1 to TH1-4, TH3-1 to TH3-2 and resistors 451 to 456 are detected by the CPU 420 as Th1-1 to Th1-4 signals and Th3-1 to Th3-2 signals. The CPU 420 converts the Th1-1 to Th1-4 signals and the Th3-1 to Th3-2 signals into temperatures. Similarly, the partial voltages between the thermistors TH2-5 to TH2-7, TH4-1 to TH4-2 and resistors 465 to 469 are detected by the CPU 420 as Th2-5 to Th2-7 signals and Th4-1 to Th4-2 signals. The CPU 420 converts the Th2-5 to Th2-7 signals and the Th4-1 to Th4-2 signals into temperatures.

In the internal processing of the CPU 420, the electric power to be supplied is calculated by, for example, PI control (proportional-integral control) on the basis of the control target temperature $TGT_i$ of each heat generation block and the detection temperature of the thermistor. Further, the electric power to be supplied is converted into a phase angle (phase control) corresponding to the electric power and a control level (duty ratio) of the wave number (wave number control), and the triacs 411 to 417 are controlled according to the control conditions.

In the heat generation blocks $HB_1$ to $HB_4$, the temperatures of the heat generation blocks are controlled on the basis of the detection temperatures of the thermistors TH1-1 to TH1-4, respectively. On the other hand, in the heat generation blocks $HB_5$ to $HB_7$, the temperatures of the heat generation blocks are controlled on the basis of the detection temperatures of the thermistors TH2-5 to TH2-7, respectively. The thermistors TH3-1 and TH4-1 are for detecting a non-sheet-passing-portion temperature rise when a recording material narrower than the total heating region length of 220 mm is passed, and are provided outside the width (182 mm) of the B5 size sheet. Further, the thermistors TH3-2 and TH4-2 are for detecting the non-sheet-passing-portion temperature rise when a recording material narrower than the length 157 mm to the heat generation blocks $HB_2$ to $HB_6$ is passed, and are provided outside the width (105 mm) of the A6 size sheet.

A relay 430 and a relay 440 are used as means for shutting off the electric power to the heater 300 when the heater 300 is overheated due to a failure or the like. The circuit operation of the relay 430 and the relay 440 will be described. When a RLON signal enters into the High state, a transistor 433 enters into the ON state, current flows from a supply voltage node Vcc to a secondary-side coil of the relay 430, and a primary-side contact of the relay 430 enters into the ON state. When the RLON signal enters into the Low state, the transistor 433 enters into the OFF state, the current flowing from the supply voltage node Vcc to the secondary-side coil of the relay 430 is blocked, and the primary-side contact of the relay 430 enters into the OFF state. Similarly, when the RLON signal enters into the High state, the transistor 443 enters into the ON state, current flows from the supply voltage node Vcc to the secondary-side coil of the relay 440, and the primary-side contact of the relay 440 enters into the ON state. When the RLON signal enters into the Low state, the transistor 443 enters into the OFF state, the current flowing from the supply voltage node Vcc to the secondary-side coil of the relay 440 is blocked, and the primary-side contact of the relay 440 enters into the OFF state. The resistor 434 and the resistor 444 are current limiting resistors.

The operation of the safety circuit using the relay 430 and the relay 440 will be described. When any one of the temperatures detected by the thermistors TH1-1 to TH1-4 exceeds the predetermined value set respectively, a comparison portion 431 operates a latch portion 432, and the latch portion 432 latches a RLOFF1 signal to the Low state. When the RLOFF1 signal enters into the Low state, even if the CPU 420 sets the RLON signal to the High state, since the transistor 433 is maintained in the OFF state, the relay 430 can be maintained in the OFF state (safe state). The latch portion 432 outputs the RLOFF1 signal in the open state in the non-latch state. Similarly, when any one of the temperatures detected by the thermistors TH2-5 to TH2-7 exceeds a predetermined value set respectively, the comparison portion 441 operates a latch portion 442, and the latch portion 442 latches a RLOFF2 signal to the Low state. When the RLOFF2 signal enters into the Low state, even if the CPU 420 sets the RLON signal to the High state, since the transistor 443 is maintained in the OFF state, the relay 440 can be maintained in the OFF state (safe state). Similarly, the latch portion 442 outputs the RLOFF2 signal in the open state in the non-latch state.

Figure 5:
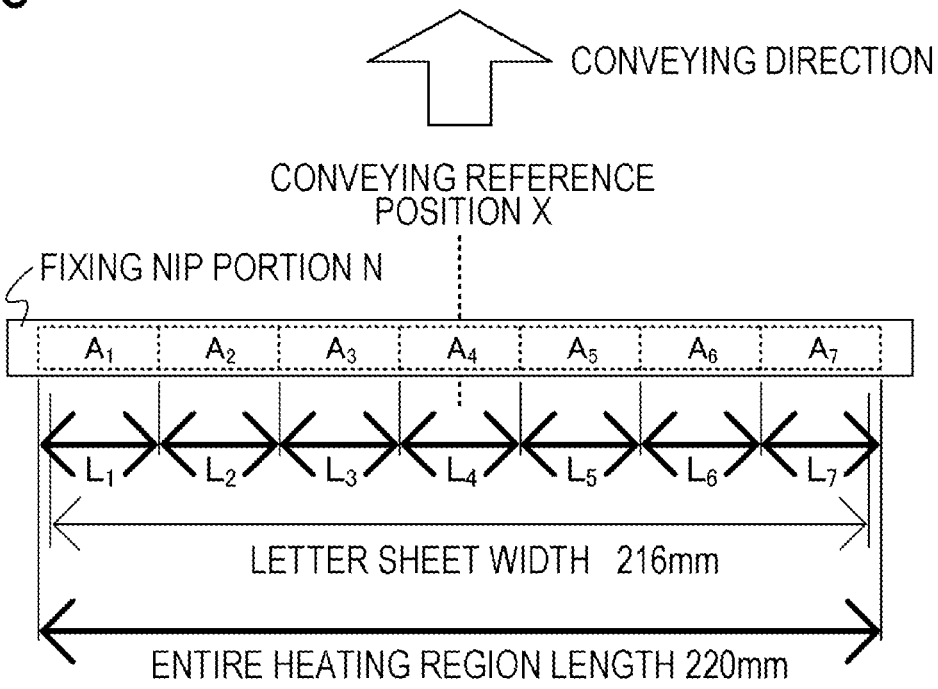
FIG. 5 is a diagram showing a heating region of the first embodiment.

FIG. 5 is a diagram showing the heating regions $A_1$ to $A_7$ in the present embodiment, and is displayed in comparison with the sheet width of the LETTER size sheet. The heating regions $A_1$ to $A_7$ are provided at positions in the fixing nip portion N corresponding to the heat generation blocks $HB_1$ to $HB_7$, and the heating regions $A_i$ (i=1 to 7) are heated by the heat generated by the heat generation blocks $HB_i$ (i=1 to 7), respectively. Assuming that the length of the heating region $A_i$ in the longitudinal direction is $L_i$, the total length $\Sigma L_i$ of the heating regions $A_1$ to $A_7$ is 220 mm, and each region is obtained by evenly dividing the total length into seven ($L_i$=31.4 mm).

In the present embodiment, the recording material P passing through the fixing nip portion N is divided into sections at a predetermined time, and the heating region $A_i$ is classified into an image forming region or a non-image forming region for each section. In the present embodiment, the section is divided every 0.24 seconds using the front end of the recording material P as a reference, and the section is divided up to the section $T_5$ such that the first section is referred to as section $T_1$, the second section is referred to as section $T_2$, and the third section is referred to as section $T_3$. The classification of the heating region $A_i$ will be described with reference to FIGS. 6A and 6B with specific examples.

Figure 6A:
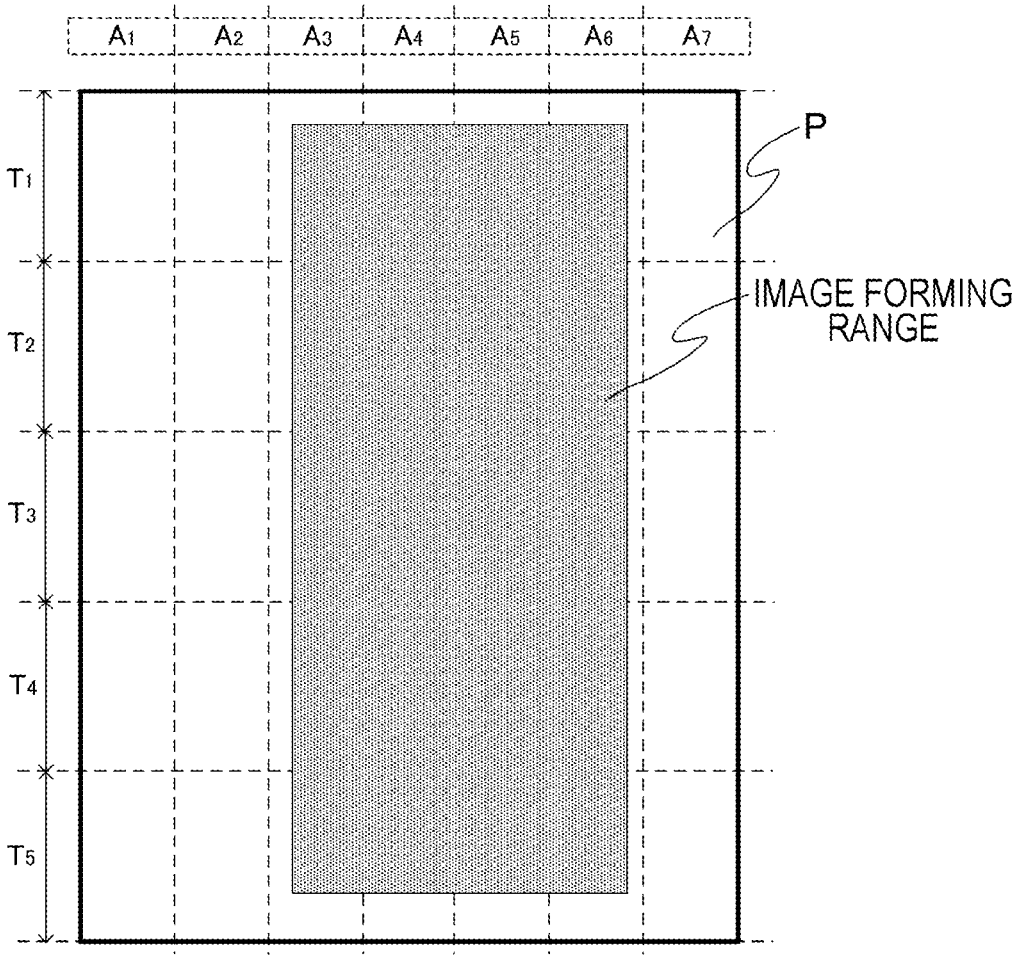

In the specific example shown in FIGS. 6A and 6B, the recording material P has a LETTER size and passes through the heating regions $A_1$ to $A_7$. When a recording material and an image are present at the positions shown in FIG. 6A, the heating region $A_i$ is classified as shown in FIG. 6B.

When the recording material overlaps an image forming range, the heating region $A_i$ (i=1 to 7) is classified as an image forming region AI, and when the recording material does not overlap the image forming range, the heating region $A_i$ is classified as a non-image forming region AP. The classification of the heating region $A_i$ is used for controlling the heat generation amount of the heat generation block $HB_i$, as will be described later.

From the information of the image forming range, in the section $T_1$, the heating regions $A_1$, $A_2$, $A_3$, and $A_4$ are classified as the image forming region AI because the regions pass through the image forming range, and the heating regions $A_5$, $A_6$, and $A_7$ are classified as the non-image forming region AP because the regions do not pass through the image forming range. In the sections $T_2$ to $T_5$, the heating regions $A_3$, $A_4$, $A_5$, and $A_6$ are classified as the image forming region AI because the regions pass through the image forming range, and the heating regions $A_1$, $A_2$, and $A_7$ are classified as the non-image forming region AP because the regions do not pass through the image forming range.

The heater control method of the present embodiment, that is, the heat generation amount control method of the heat generation block $HB_i$ (i=1 to 7) will be described.

The amount of heat generated by the heat generation block $HB_i$ is determined by the power supplied to the heat generation block $HB_i$. When the electric power supplied to the heat generation block $HB_i$ is increased, the heat generation amount of the heat generation block $HB_i$ increases, and when the electric power supplied to the heat generation block $HB_i$ is decreased, the heat generation amount of the heat generation block $HB_i$ decreases.

The power supplied to the heat generation block $HB_i$ is calculated on the basis of the control temperature (control target temperature) $TGT_i$ (i=1 to 7) set for each heat generation block and the detection temperature of the thermistor. In the present embodiment, the power to be supplied is calculated by PI control (proportional-integral control) so that the detection temperature of each thermistor becomes equal to the control temperature $TGT_i$ of each heat generation block.

In the above-described configuration, since the heat generation amount can be changed for each heat generation block, it is possible to create various heat generation distributions of the heater 300 in the longitudinal direction.

Figure 7A:
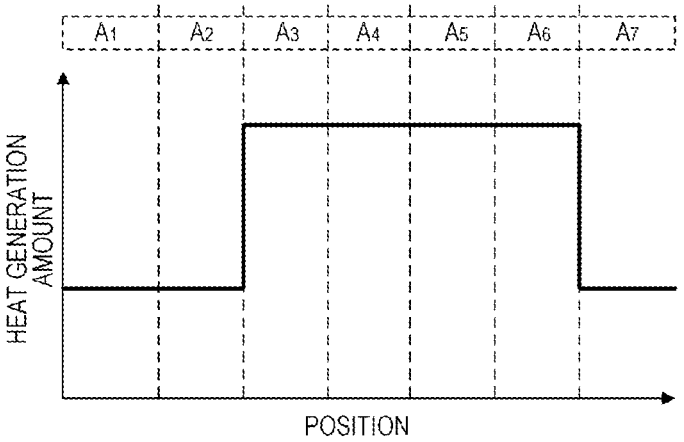
FIGS. 7A and 7B are diagrams for explaining the mechanism of generation of transversely moving force in the first embodiment.

FIG. 7A is a diagram schematically showing the heat generation distribution in the longitudinal direction of the heater 300, and as shown in FIG. 7A, the heat generation distribution in the longitudinal direction of the heater 300 may be created such that the heat generation amount is increased on one side only. In this way, when a lateral difference is created in the heat generation amount in the longitudinal direction of the heater 300, a transversely moving force that causes the fixing film 202 to move toward the side where the heat generation amount is larger (force acting on the fixing film 202 in the longitudinal direction) occurs. The cause of this transversely moving force will be described with reference to FIGS. 7A and 7B.

Figure 7B:
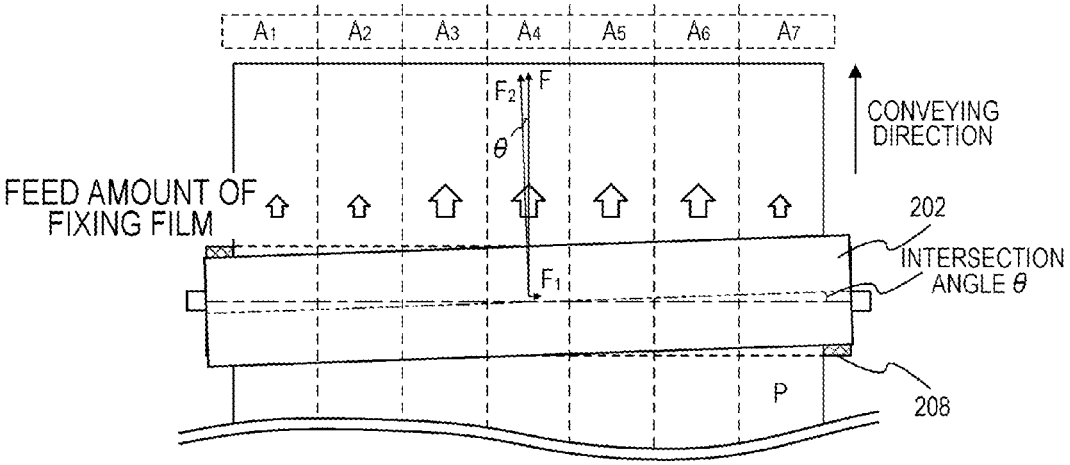

FIG. 7B is a diagram of the fixing device 200 viewed from a direction perpendicular to the plane parallel to the conveying direction of the recording material, and schematically shows a state in which a transversely moving force acts on the fixing film 202. The lateral difference in the heat generation amount in the longitudinal direction of the heater 300 as shown in FIG. 7A causes a lateral temperature difference in the longitudinal direction of the pressure roller 208. This lateral temperature difference is the difference in thermal expansion of the elastic layer of the pressure roller, and the outer diameter of the pressure roller in the heating regions $A_5$ to $A_7$, which are at high temperature, is larger than that in the heating regions $A_1$ to $A_3$. Therefore, a lateral difference occurs in the feed amount of the fixing film by the pressure roller as indicated by the block arrow in FIG. 7B, and the feed amount of the fixing film on the high temperature side is larger than the feed amount of the fixing film on the low temperature side. Since there is a clearance between the fixing film 202 and the inner surface facing portion of the fixing flange 213, an intersection angle θ is generated between the generatrix of the pressure roller 208 and the generatrix of the fixing film 202 due to the difference in the feed amount of the fixing film. Since the fixing film 202 receives the force F due to the rotation of the pressure roller 208, the force F is decomposed into the generatrix direction $F_1=F\cdot\sin\theta$ of the fixing film 202 and the direction $F_2=F\cdot\cos\theta$ orthogonal thereto due to the intersection angle θ. Due to this force $F_1$ (transversely moving force), the fixing film 202 moves closer to the side where the feed amount of the fixing film is large, that is, the side where the heat generation amount of the heater 300 is large.

Due to the leaning movement of the fixing film 202, the end surface of the fixing film on the side where the heat generation amount is large abuts against the regulation surface of the fixing flange 213, and the fixing film 202 and the fixing flange 213 rub against each other. This transversely moving force may cause scraping of the fixing film ends, and if the transversely moving force is larger, the fixing film may be damaged such as bending, buckling, and cracking. Damages to the fixing film may shorten the life of the fixing device.

Here, the present inventor has experimentally found that the transversely moving force of the fixing film 202 is correlated with the lateral difference in the average temperature in the longitudinal direction of the heater 300. That is, it was found that the larger the lateral difference in the average temperature of the heater, the greater the transversely moving force of the fixing film 202.

The results of an experiment carried out to examine the relationship between the transversely moving force of the fixing film 202 and the temperature distribution in the longitudinal direction of the heater 300 are described below.

The experiment was carried out according to the following procedure.

After confirming that the temperature of the fixing device is the same as the room temperature, continuous printing is performed for each set of 100 pages of LETTER size sheet. Since the fixing device can set various control temperatures $TGT_i$ (i=1 to 7) for each heat generation block, it is possible to set various temperature distributions in the longitudinal direction of the heater 300. Table 1 is a table showing the conditions of the control temperature of each heating region of the heater 300 in this experiment. In this experiment, as shown in Table 1, nineteen temperature distributions in the longitudinal direction of the heater 300 were set, and each set of sheets was continuously printed in each temperature distribution. During continuous printing, the control temperature is set to be constant regardless of whether the sheet is being passed or between sheets.

TABLE 1

| | Control temperature (° C.) | | | | | | |
|---|---|---|---|---|---|---|---|
| Condition | $TGT_1$ | $TGT_2$ | $TGT_3$ | $TGT_4$ | $TGT_5$ | $TGT_6$ | $TGT_7$ |
| 1 | 225 | 225 | 225 | 225 | 225 | 225 | 225 |
| 2 | 195 | 195 | 225 | 225 | 225 | 225 | 225 |
| 3 | 225 | 225 | 225 | 225 | 225 | 195 | 195 |
| 4 | 105 | 105 | 225 | 225 | 225 | 225 | 105 |
| 5 | 105 | 225 | 225 | 225 | 225 | 105 | 105 |
| 6 | 125 | 125 | 225 | 225 | 225 | 225 | 225 |
| 7 | 225 | 225 | 225 | 225 | 225 | 125 | 125 |
| 8 | 235 | 235 | 225 | 225 | 225 | 225 | 225 |
| 9 | 225 | 225 | 225 | 225 | 225 | 235 | 235 |
| 10 | 212 | 225 | 225 | 225 | 225 | 225 | 225 |
| 11 | 225 | 225 | 225 | 225 | 225 | 225 | 212 |
| 12 | 199 | 225 | 225 | 225 | 225 | 225 | 225 |
| 13 | 225 | 225 | 225 | 225 | 225 | 225 | 199 |
| 14 | 228 | 225 | 225 | 225 | 225 | 225 | 225 |
| 15 | 225 | 225 | 225 | 225 | 225 | 225 | 228 |
| 16 | 125 | 125 | 225 | 225 | 225 | 225 | 191 |
| 17 | 191 | 225 | 225 | 225 | 225 | 125 | 125 |
| 18 | 121 | 135 | 180 | 180 | 180 | 225 | 239 |
| 19 | 239 | 225 | 180 | 180 | 180 | 135 | 121 |

Further, in this experiment, in order to measure the transversely moving force of the fixing film 202, a load cell for detecting pressure was attached to the end of the fixing flange 213. When a transversely moving force acts on the fixing film 202 and the fixing film 202 abuts against the fixing flange 213, the load cell detects the pressure. This detected pressure is equal to the transversely moving force acting on the fixing film 202. With this load cell, continuous printing was performed while measuring the transversely moving force.

Figure 8A:
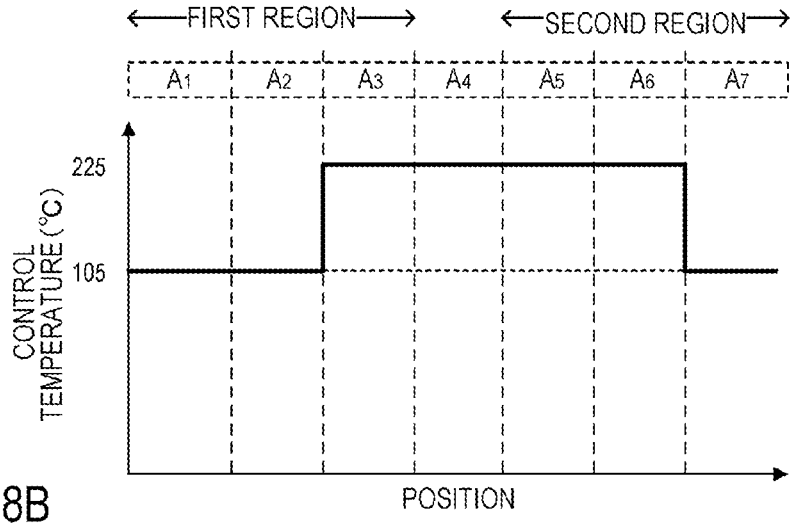
FIGS. 8A to 8C are diagrams showing the experimental results of the first embodiment.

FIG. 8A is a diagram showing the control in the temperature distribution pattern of condition 4, which is one condition of the control temperature of the heater 300 in this experiment. By setting the control temperature on the basis of this temperature distribution pattern, a lateral difference is created in the control temperature so that the temperature is higher on the heating region $A_7$.

Figure 8B:
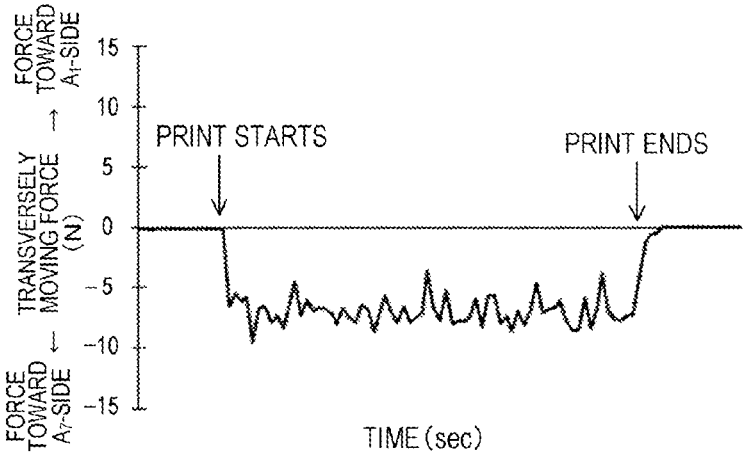

FIG. 8B is a diagram showing a change in the transversely moving force during continuous printing when the control temperature is set as shown in FIG. 8A. Here, the positive sign of the transversely moving force indicates that the fixing film has moved toward the heating region $A_1$ and the transversely moving force has been detected by the load cell on the heating region $A_1$. On the other hand, the negative sign of the transversely moving force indicates that the fixing film has moved toward the heating region $A_7$ and the transversely moving force has been detected by the load cell on the heating region $A_7$. From FIG. 8B, it can be understood that the transversely moving force of the fixing film acts on the heating region $A_7$ where the temperature is high. In addition, it can be understood that the transversely moving force is generated immediately after the start of printing and remains almost constant at a value near −7.5 N until the end of printing. This tendency was also seen in other temperature distribution settings.

Figure 8C:
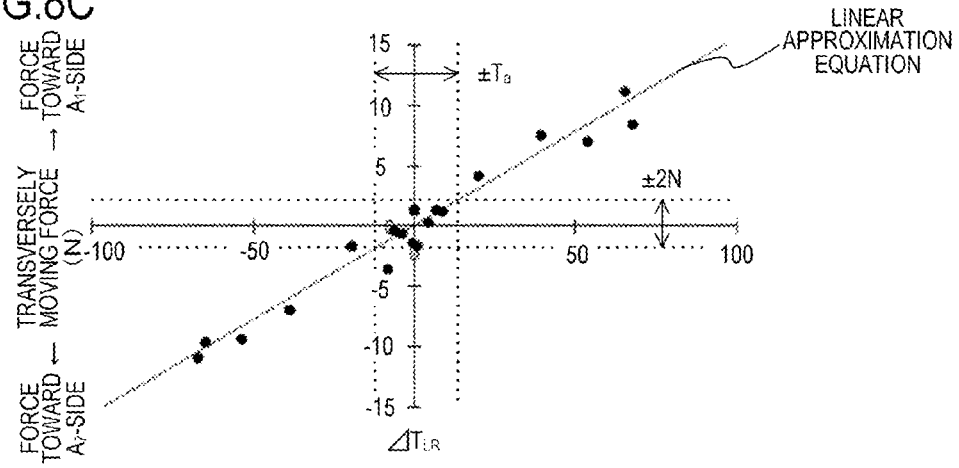

FIG. 8C is a diagram showing the relationship between the lateral temperature difference in the longitudinal direction of the heater and the transversely moving force of the fixing film in each continuous printing obtained by all nineteen continuous printings in this experiment. Here, $\Delta T_{LR}$ is defined as an index showing the lateral temperature difference. $\Delta T_{LR}$ is defined as $\Delta T_{LR} \equiv T_L - T_R$, where $T_L$ is the average value of the control temperatures $TGT_i$ in the heating regions $A_1$, $A_2$, and $A_3$ as the first region and $T_R$ is the average value of the control temperatures $TGT_i$ in the heating regions $A_5$, $A_6$, and $A_7$ as the second region. That is, $\Delta T_{LR}$ represents the difference between the average values of the left and right control temperatures.

$T_L$ and $T_R$ are calculated by the following equations.

$$T_L = \Sigma(TGT_i \cdot L_i)/\Sigma L_i \quad (i=1, 2, 3) \qquad \text{(Equation 1)}$$

$$T_R = \Sigma(TGT_i \cdot L_i)/\Sigma L_i \quad (i=5, 6, 7) \qquad \text{(Equation 2)}$$

As shown in FIG. 8C, it can be understood that there is a strong correlation between the transversely moving force of the fixing film and $\Delta T_{LR}$. From this result, it was found that the transversely moving force of the fixing film can be predicted by $\Delta T_{LR}$ which shows the difference between the left and right average temperatures of the heater as an index showing the lateral temperature difference.

In the present embodiment, by introducing the temperature control that reflects the relationship between the transversely moving force of the fixing film and $\Delta T_{LR}$, the film breakage is suppressed and the life of the fixing device is extended as much as possible.

A method of setting the control temperature $TGT_i$ of each heat generation block in the present embodiment will be described.

In the present embodiment, the control temperature $TGT_i$ is set so that the lateral temperature difference in the longitudinal direction of the heater 300 is within a predetermined value range. That is, it is set so that $-T_a \leq \Delta T_{LR} \leq T_a$ is set as a predetermined temperature range. Here, the threshold value $T_a$ is determined from the allowable range of the transversely moving force of the fixing film generated due to the lateral temperature difference. The allowable range of the transversely moving force of the fixing film generated due to the lateral temperature difference in the present embodiment is −2N to 2N. Within this allowable range, the load on the fixing film caused by the fixing film abutting against the regulation surface of the fixing flange could be suppressed, and the film was not damaged within the life of the fixing device.

From FIG. 8C, the range of $\Delta T_{LR}$ in which the allowable range of the transversely moving force of the fixing film is −2N to 2N is read as $-10° C. \leq \Delta T_{LR} \leq 10° C.$ Therefore, in this example, $T_a$=10° C. was set as the threshold value. In the present embodiment, the allowable range of the transversely moving force of the fixing film is −2N to 2N, but the allowable range of the transversely moving force of the fixing film is not limited to this range. The allowable range is appropriately set according to conditions such as the outer diameter, thickness, and material of the fixing film, and the process speed.

Figure 9:
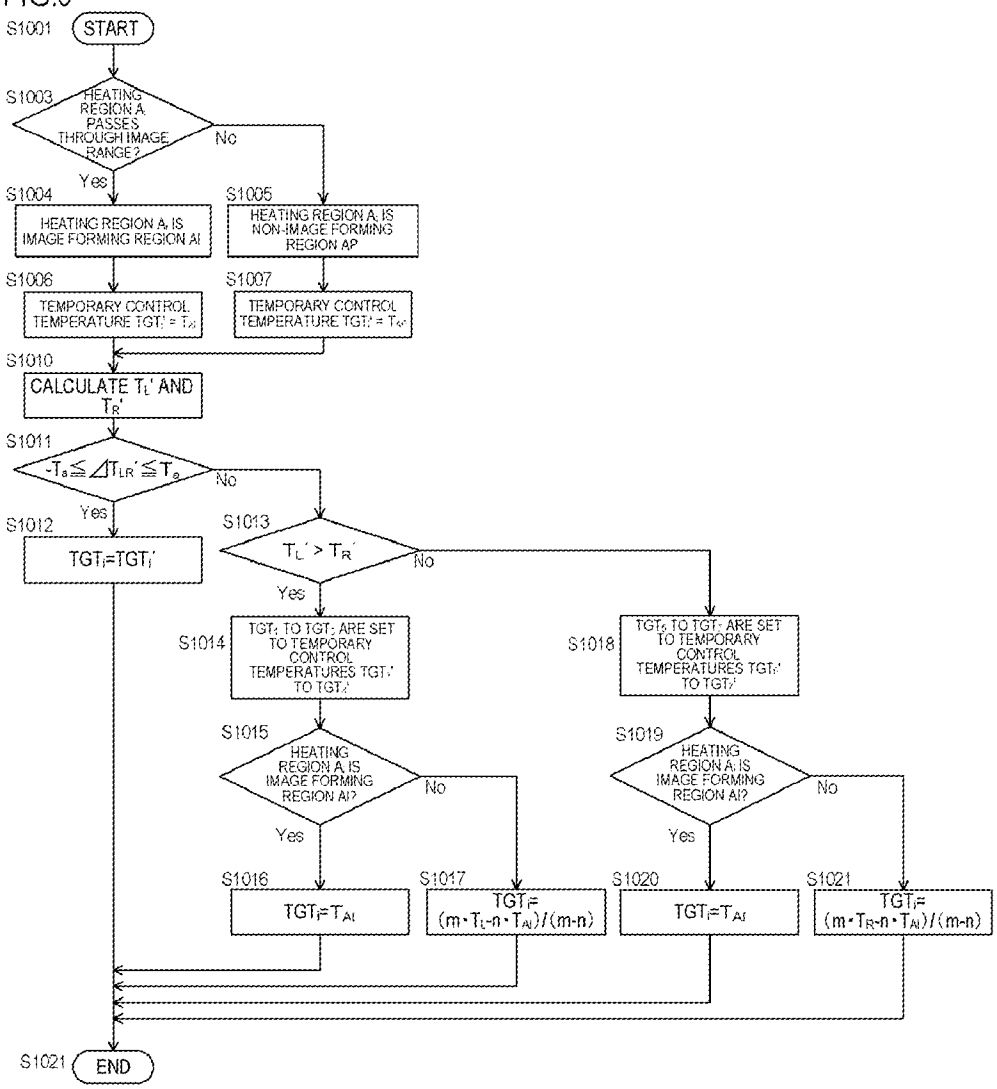
FIG. 9 is a flowchart for classifying the heating region and determining the control temperature in the first embodiment.

A method of setting the control temperature $TGT_i$ will be described with reference to the flowchart of FIG. 9. Here, as a specific example, a method of setting the control temperature $TGT_i$ in the sections $T_1$ to $T_5$ when a recording material and an image are present at the positions as shown in FIG. 6A will also be described. As shown in the flowchart of FIG. 9, each heating region $A_i$ (i=1 to 7) is classified into an image forming region AI as an image heating region and a non-image forming region AP as a non-image heating region.

The classification of the heating region $A_i$ is performed on the basis of the information of the image forming range transmitted from an external device (not shown) such as a host computer, and is determined depending on whether the heating region $A_i$ passes through the image forming range (S1003). When the heating region passes through the image forming range, the heating region $A_i$ is classified as the image forming region AI (S1004), and when the heating region does not pass through the image forming range, the heating region $A_i$ is classified as the non-image forming region AP (S1005).

When the heating region passes through the image forming range, the heating region $A_i$ is classified as the image forming region AI, and a temporary control temperature $TGT_i'$ is set as $TGT_i'=T_{AI}$ (S1006). Here, $T_{AI}$ is set as an appropriate temperature for fixing a non-fixed image on the recording material P. When a plain sheet passes in the fixing device 200 of the present embodiment, $T_{AI}$=198° C. is set as a preset control target temperature. It is desirable that the $T_{AI}$ is variable according to the type of recording material P such as thick sheet and thin sheet. Further, $T_{AI}$ may be adjusted according to the information of the image such as an image density and a pixel density.

When the heating region $A_i$ is classified as the non-image forming region AP, the temporary control temperature $TGT_i'$ is set as $TGT_i'=T_{AP}$ (S1007). Here, by setting the $T_{AP}$ to a temperature lower than the $T_{AI}$, the amount of heat generated by the heat generation block $HB_i$ in the non-image forming region AP is lower than that of the image forming region AI, and the power-saving of the image forming apparatus 100 is achieved. In the present embodiment, the preset control target temperature is set as $T_{AP}$=158° C.

Figure 10A:
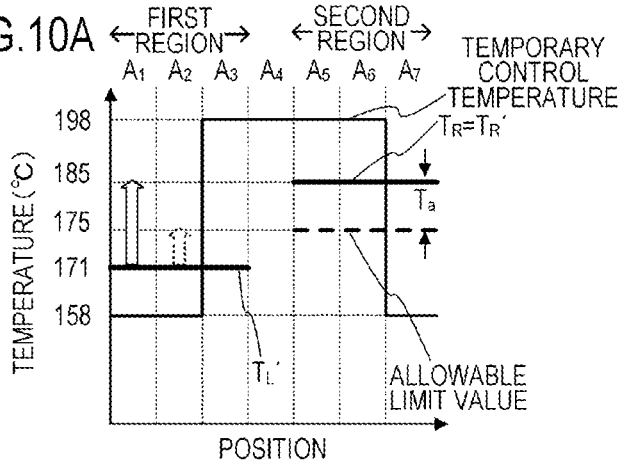
FIGS. 10A to 10C are diagrams showing a temporary control target temperature and a control target temperature of each heating region of the first embodiment.

Here, FIG. 10A is a diagram showing temporary control temperatures $TGT_i'$ of the heating regions $A_1$ to $A_7$ in a specific example. In the specific example, since the heating region $A_i$ is classified as shown in FIG. 6B, the temporary control temperature is set as indicated by the fine solid line in FIG. 10A on the basis of this classification.

Once the temporary control temperature $TGT_i'$ is determined, the control temperature $TGT_i$ to be actually used is determined on the basis of this. In the present embodiment, since the heating region $A_4$ is located in the central portion in the longitudinal direction of all heating regions, the control temperature $TGT_4$ in the heating region $A_4$ is set to $TGT_4=TGT_4'$.

First, $T_L'$ and $T_R'$ are calculated, where $T_L'$ is the average value of $TGT_i'$ in the heating regions $A_1$, $A_2$, and $A_3$, and $T_R'$ is the average value of $TGT_i'$ in the heating regions $A_5$, $A_6$, and $A_7$ (S1010). In addition, $T_L'$ and $T_R'$ are calculated in the same manner as $T_L$ and $T_R$, respectively. Here, in a specific example, the average values are calculated as $T_L'$=171° C. and $T_R'$=185° C.

Next, it is determined whether the difference $\Delta T_{LR}'=T_L'-T_R'$ between $T_L'$ and $T_R'$ is within the range of $-T_a$ to $T_a$ (S1011).

When $\Delta T_{LR}'$ is in the range of $-T_a$ to $T_a$, it can be predicted that the transversely moving force of the fixing film generated due to the lateral temperature difference is within the allowable value. Therefore, the temporary control temperature $TGT_i'$ is set as the actual control temperature $TGT_i$ as it is (S1012). Then, the flow proceeds to S1021 and the control temperature setting flow ends.

On the other hand, when $\Delta T_{LR}'$ is outside the range of $-T_a$ to $T_a$, it can be predicted that the transversely moving force of the fixing film generated due to the lateral temperature difference is out of the allowable range. Therefore, the flow proceeds to the flow for setting the control temperature $TGT_i$ so that the lateral temperature difference is eliminated, and first, in S1013, it is determined which of $T_L'$ and $T_R'$ is larger.

Here, in the specific example, since the difference between $T_L'$ and $T_R'$ is $\Delta T_{LR}'=T_L'-T_R'=-14°$ C., it is determined that $\Delta T_{LR}'$ is out of the range of $-T_a$ to $T_a$, and the flow proceeds to S1013.

In S1013, when it is determined that the average value $T_L'$ in the first region on one end side is larger than that in the heating region at the center in the longitudinal direction of the heater, the temporary control temperature $TGT_i'$ in the heating regions $A_1$, $A_2$, and $A_3$ which are the first regions is set to the control temperature $TGT_i$ (S1014). On the other hand, the control temperature $TGT_i$ in the heating regions $A_5$, $A_6$, and $A_7$, which are the second regions on the other end side of the heating region at the center in the longitudinal direction of the heater, is set so that the average value $T_R$ of the control temperatures in the second regions is equal to the average value $T_L$ of the first regions. That is, the control temperature $TGT_i$ is set so as to satisfy the relationship of $T_R=T_L$.

In S1015, among the heating regions $A_5$, $A_6$, and $A_7$, those classified as the image forming region AI are determined. The control temperature $TGT_i$ in the heating region $A_i$ classified as the image forming region AI in S1015 is set to the $T_{AI}$ (S1016). On the other hand, the control temperature $TGT_i'$ of the heating region $A_i$ classified as the non-image forming region AP in S1015 is determined by the following equation (S1017).

$$TGT_i=(m\cdot T_L-n\cdot T_{AI})/(m-n) \quad \text{(Equation 3)}$$

Here, m is the number of heating regions in the second region, and m=3. Further, n is the number of heating regions classified as the image forming region AI in S1015.

By the above-described calculation, the control temperature $TGT_i$ in the heating regions $A_5$, $A_6$, and $A_7$ can be set so as to satisfy the relationship of $T_R=T_L$ by being changed from the preset temperature.

Separately from this, when it is determined in S1013 that $T_R'$ is larger, the temporary control temperature $TGT_i'$ in the heating regions $A_5$, $A_6$, and $A_7$ in the second region is set to the control temperature $TGT_i$ (S1018). On the other hand, the flow proceeds to S1019 so that the control temperature $TGT_i$ in the heating regions $A_1$, $A_2$, and $A_3$, which are the first region is set so as to satisfy the relationship of $T_L=T_R$.

In S1019, among the heating regions $A_1$, $A_2$, and $A_3$ in the first region, those classified as the image forming region AI are determined, and the control temperature $TGT_i$ of the heating region $A_i$ classified as the image forming region AI in S1020 is set to $T_{AI}$. On the other hand, the control temperature $TGT_i'$ of the heating region $A_i$ classified as the non-image forming region AP in S1019 is determined in S1021 by the following equation.

$$TGT_i=(m\cdot T_R-n\cdot T_{AI})/(m-n) \quad \text{(Equation 4)}$$

Here, m is the number of heating regions in the first region, and m=3. Further, n is the number of heating regions classified as the image forming region AI in S1019.

In a specific example, $T_L'$ and $T_R'$ are $T_L'=171°$ C. and $T_R'=185°$ C., respectively, and are indicated by thick solid lines in FIG. 10A. Therefore, in the specific example, it is determined that $T_L'<T_R'$ (S1013). Then, the control temperatures $TGT_i$ of the heating regions $A_5$, $A_6$, and $A_7$ in the second region are set to the values indicated by the fine solid lines in FIG. 10A (S1018).

In the subsequent steps, the average value $T_L$ of the control temperature in the first region is set to be equal to the average value $T_R$ in the second region. That is, the average value $T_L$ of the control temperature in the first region is set to be the temperature indicated by the block solid-line arrow in FIG. 10A.

Therefore, in S1019, among the heating regions $A_1$, $A_2$, and $A_3$, which are the first regions, heating regions classified as the image forming region AI and the other heating regions are determined. Here, the control temperature $TGT_3$ of the heating region $A_3$ classified as the image forming region AI is set to $T_{AI}$ in S1020. On the other hand, the control temperatures of the heating regions $A_1$ and $A_2$ that are not classified as the image forming region AI are calculated using Equation 4. Substituting $T_R=185°$ C., $T_{AI}=198°$ C., m=3, n=1 into Equation 4, the control temperature $TGT_1$ in the heating region $A_1$ is calculated as follows.

$$TGT_1=(3\cdot 185-1\cdot 198)/(3-1)=178$$

Similar to $TGT_1$, $TGT_2$ is calculated as $TGT_2=178°$ C.

Figure 10B:
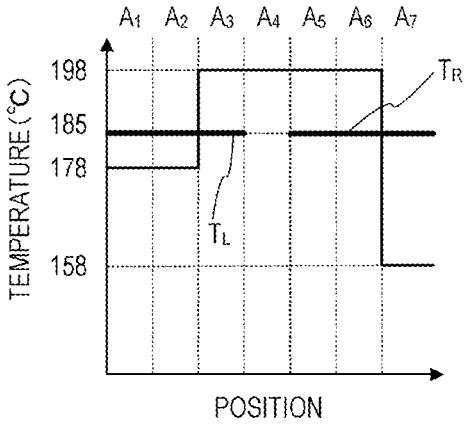

FIG. 10B is a diagram showing the control temperatures in the heating regions $A_1$ to $A_7$ finally determined in the specific example, and the final control temperatures are indicated by a fine solid line. In FIG. 10B, the average values $T_L$ and $T_R$ of the control temperatures in each of the first region and the second region are indicated by thick solid lines, and the control temperatures are set so that $T_L$ and $T_R$ are equal.

Figure 10C:
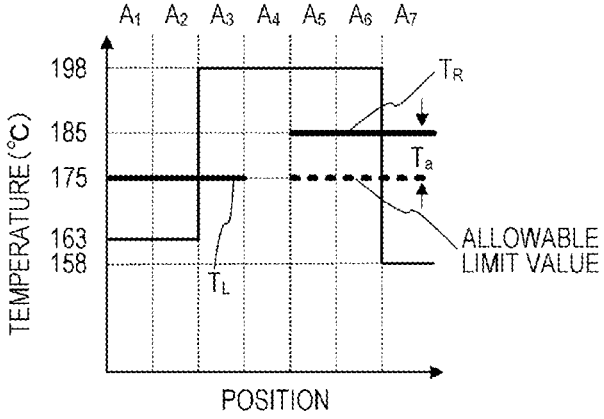

In the present embodiment, the control temperature is set so that the average value $T_L$ of the control temperatures in the first region and the average value $T_R$ of the second regions are equal to each other, that is, $T_L=T_R$. However, it is not always necessary to set the control temperature so that $T_L=T_R$. Even if the average value $T_L$ of the control temperatures in the first region and the average value $T_R$ in the second region are not equal, if the lateral temperature difference $\Delta T_{LR}=T_L-T_R$ is within the range of −Ta to Ta, the transversely moving force of the fixing film can be maintained to be within the allowable range. For example, the average value $T_L$ of the control temperatures in the first region may be set to be the temperature indicated by the block dot-line arrow in FIG. 10A, that is, the allowable limit value of the lateral temperature difference. At this time, the finally determined control temperatures of the heating regions $A_1$ to $A_7$ are set to the values indicated by the fine solid lines in FIG. 10C.

The control temperature $TGT_i$ is set according to the above-described flow.

Next, in order to confirm the effect of the present embodiment, the results of comparison of the transversely moving force acting on the fixing film 202 and the power consumption of the fixing device when the temperature control of the comparative example is used and when the temperature control of the present embodiment is used will be described. As comparative examples, Comparative Example 1 in which each heat generation block is selectively heat-controlled according to the presence of an image on a recording material and Comparative Example 2 in which the heater is heated so that the temperature distribution in the longitudinal direction becomes flat are used.

First, a method of setting the control temperature $TGT_i$ of Comparative Example 1 will be described.

In Comparative Example 1, the control temperature $TGT_i$ is set on the basis of the classification of the heating region $A_i$. The classification of the heating region $A_i$ is performed on the basis of the information of the image forming range as in the present embodiment, and is determined depending on whether the heating region $A_i$ passes through the image forming range. When the heating region passes through the image forming range, the heating region $A_i$ is classified as the image forming region AI, and when the heating region does not pass through the image forming range, the heating region $A_i$ is classified as the non-image forming region AP. Then, when the heating region $A_i$ is classified as the image forming region AI, the control temperature $TGT_i$ is set to $TGT_i=T_{AI}$, and when the heating region $A_i$ is classified as the image forming region AP, the control temperature $TGT_i$ is set to $TGT_i=T_{AP}$.

The control temperature $TGT_i$ of Comparative Example 2 is set so that the control temperature of all heating regions is $TGT_i=T_{AP}$, and the temperature distribution in the longitudinal direction of the heater is flat.

The effect of this example was confirmed by measuring the transversely moving force of the fixing film 202 during printing when the temperature control of each of the comparative example and the present embodiment was used. The transversely moving force of the fixing film 202 was measured by attaching a load cell for detecting pressure to the end of the fixing flange 213 as in the above-mentioned experiment. Further, as a condition for printing, in both the comparative example and the present embodiment, the life of the fixing device was set to 150,000 sheets, and LETTER size sheet was continuously printed. Then, as the image to be printed, the image shown in FIG. 6A was prepared, and the image was continuously printed in each of the comparative example and the present embodiment. The control temperature in the comparative example is set as indicated by the fine solid line in FIG. 10A, and the control temperature in the present embodiment is set as indicated by the fine solid line in FIG. 10B.

Table 2 is a table showing the results of effect confirmation, and shows the control temperature when each image is continuously printed, the average value of the transversely moving force during printing, the life arrival rate, and the power-saving property. Here, the life arrival rate is an index indicating how many sheets can be passed with respect to the life of the fixing device without causing damage to the fixing film. Further, the power-saving property is indicated by adding a negative sign to indicate how much percent (%) the power consumption can be reduced when the power consumption of Comparative Example 2 is 100%.

TABLE 2

| | Control temperature (° C.) | | | | | | | Transversely moving force | Life arrival | Power-saving |
|---|---|---|---|---|---|---|---|---|---|---|
| | $TGT_1$ | $TGT_2$ | $TGT_3$ | $TGT_4$ | $TGT_5$ | $TGT_6$ | $TGT_7$ | (kgf) | rate (%) | property (%) |
| Comparative Example 1 | 158 | 158 | 198 | 198 | 198 | 198 | 158 | 0.22 | 90 | −10 |
| Comparative Example 2 | 198 | 198 | 198 | 198 | 198 | 198 | 198 | 0.01 | 100 | 0 |
| Present embodiment | 178 | 178 | 198 | 198 | 198 | 198 | 158 | 0.01 | 100 | −7 |

From these results, it can be understood that Comparative Example 1 is the most excellent in power-saving property, but the life arrival rate of the fixing device is 90%, which shortens the life of the fixing device. Further, in Comparative Example 2, it can be understood that the life arrival rate of the fixing device is 100%, but the power-saving property is inferior.

On the other hand, in the present embodiment, it is possible to achieve a life arrival rate of 100% for the fixing device while achieving power-saving.

As described above, by introducing the heater temperature control of the present embodiment, it is possible to suppress the occurrence of film breakage due to the leaning movement of the film and extend the life of the fixing device while achieving power-saving.

In the present embodiment, the control temperature is determined so that the average value $T_L$ of the control temperature in the first region and the average value $T_R$ of the control temperature in the second region are equal to the larger value of $T_L'$ and $T_R'$, but there is no limitation thereto. The control temperature may be determined so that the average value is equal to the smaller value of $T_L'$ and $T_R'$.

The method for determining the control temperature in this case will also be described with reference to the above-mentioned specific example.

Figure 11A:
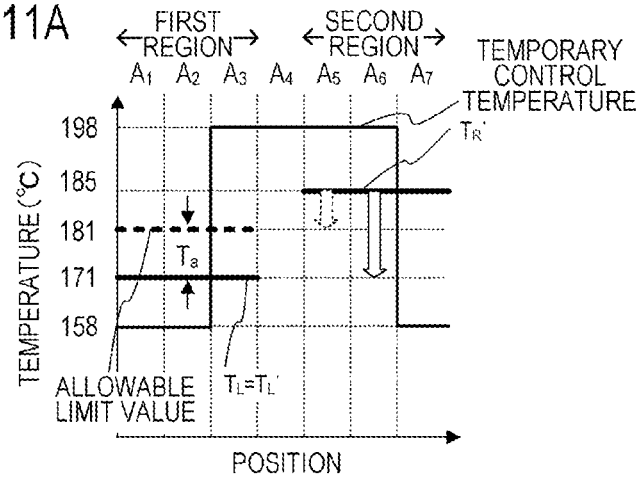
FIGS. 11A to 11C are diagrams showing a temporary control target temperature and a control target temperature of each heating region of the first embodiment.
Figure 11B:
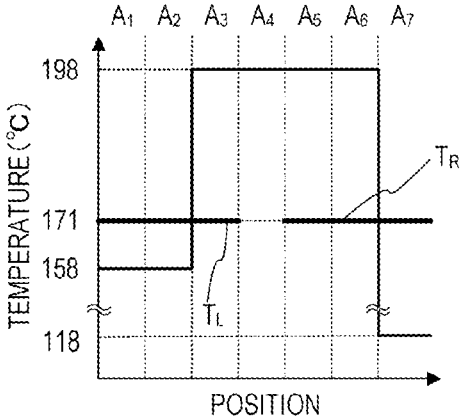

FIG. 11A is a diagram showing temporary control temperatures $TGT_i'$ of the heating regions $A_1$ to $A_7$ in the specific example, and the temporary control temperatures are set as indicated by fine solid lines in FIG. 11A. In a specific example, $T_L'$=171° C. and $T_R'$=185° C., which are indicated by thick solid lines in FIG. 11A. Here, since $T_L'$ is smaller than $T_R'$, the average value $T_R$ of the control temperature in the second region is set to be the same temperature as the temperature $T_L'$ indicated by the block solid-line arrow in FIG. 11A. Then, the finally determined control temperatures of the heating regions $A_1$ to $A_7$ are set as indicated by the fine solid lines in FIG. 11B. In FIG. 11B, the average values $T_L$ and $T_R$ of the control temperatures in the first region and the second region indicated by the thick solid line are set to be equal to each other.

Figure 11C:
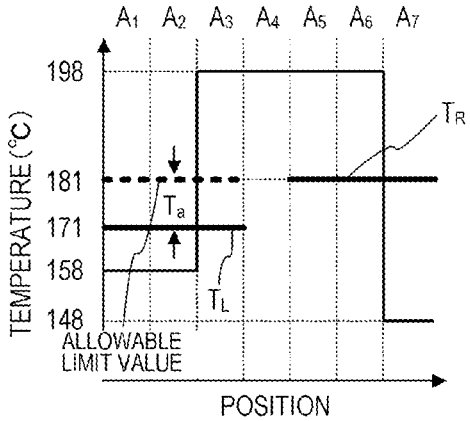

In this case, the control temperature is set so that the average value $T_L$ of the control temperatures in the first region and the average value $T_R$ of the second regions are equal to each other, that is, $T_L=T_R$. However, it is not always necessary to set the control temperature so that $T_L=T_R$. Even if the average value $T_L$ of the control temperatures in the first region and the average value $T_R$ in the second region are not equal, if the lateral temperature difference $\Delta T_{LR}=T_L-T_R$ is within the range of −Ta to Ta, the transversely moving force of the fixing film can be maintained to be within the allowable range. The average value $T_R$ of the control temperatures in the second region may be set to be the temperature indicated by the block dot-line arrow in FIG. 11A, that is, the allowable limit value of the lateral temperature difference. At this time, the finally determined control temperatures of the heating regions $A_1$ to $A_7$ are set to the values indicated by the fine solid lines in FIG. 11C.

Figure 12:
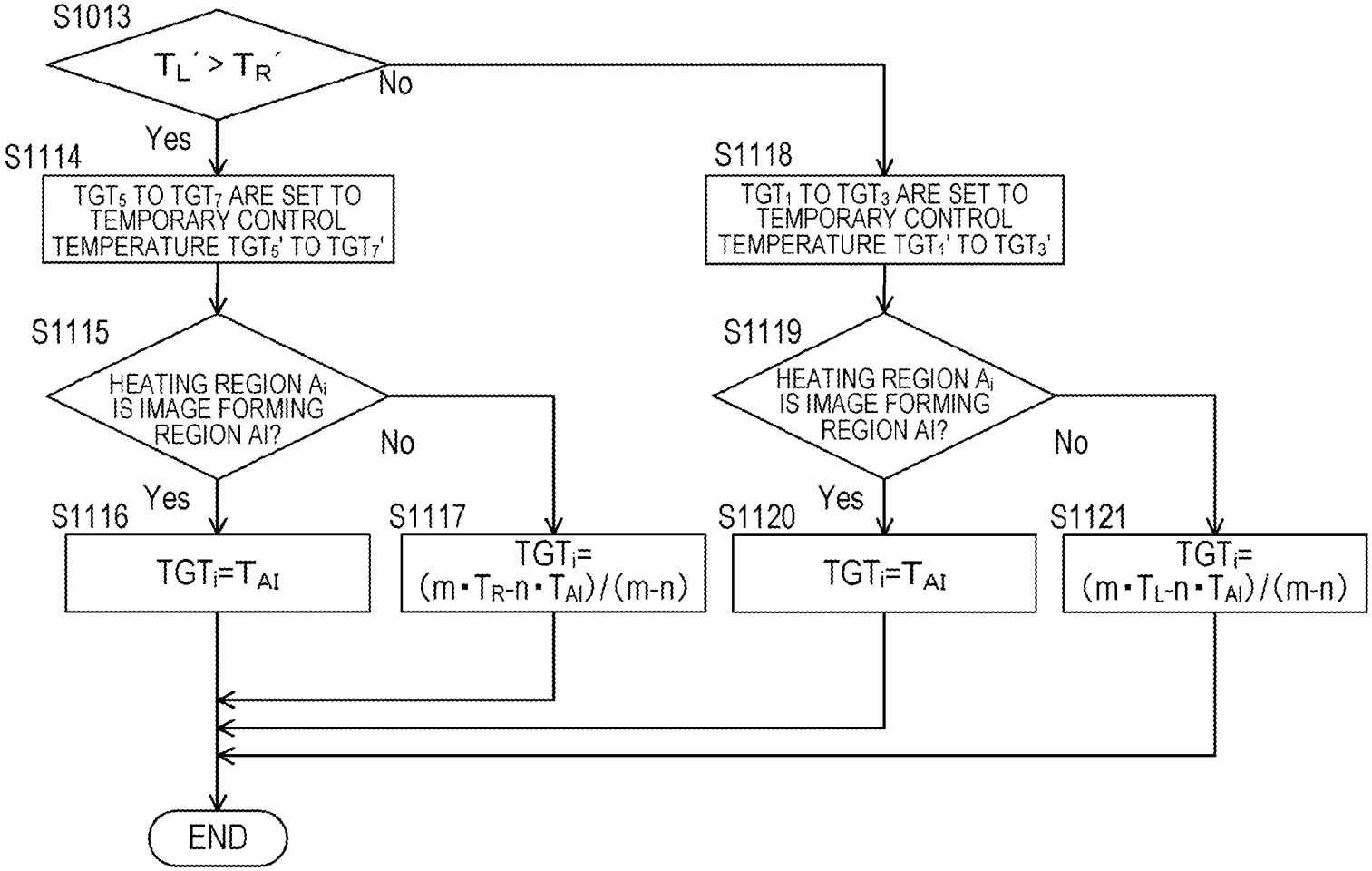
FIG. 12 is a flowchart for classifying the heating region and determining the control temperature in the first embodiment.

When the control temperature is determined in this way, the control temperature may be determined according to the flow in which the steps after S1013 in the flowchart of FIG. 9 are replaced with the flowchart of FIG. 12.

In addition to the method for determining the control temperature described above, the control temperature may be determined so that the average value $T_L$ of the control temperature in the first region and the average value $T_R$ of the control temperature in the second region are equal to the average value $T_{ALL}$ of the temporary control temperature of all regions (a plurality of heating regions).

The method for determining the control temperature in this case will also be described with reference to the above-mentioned specific example.

Figure 13A:
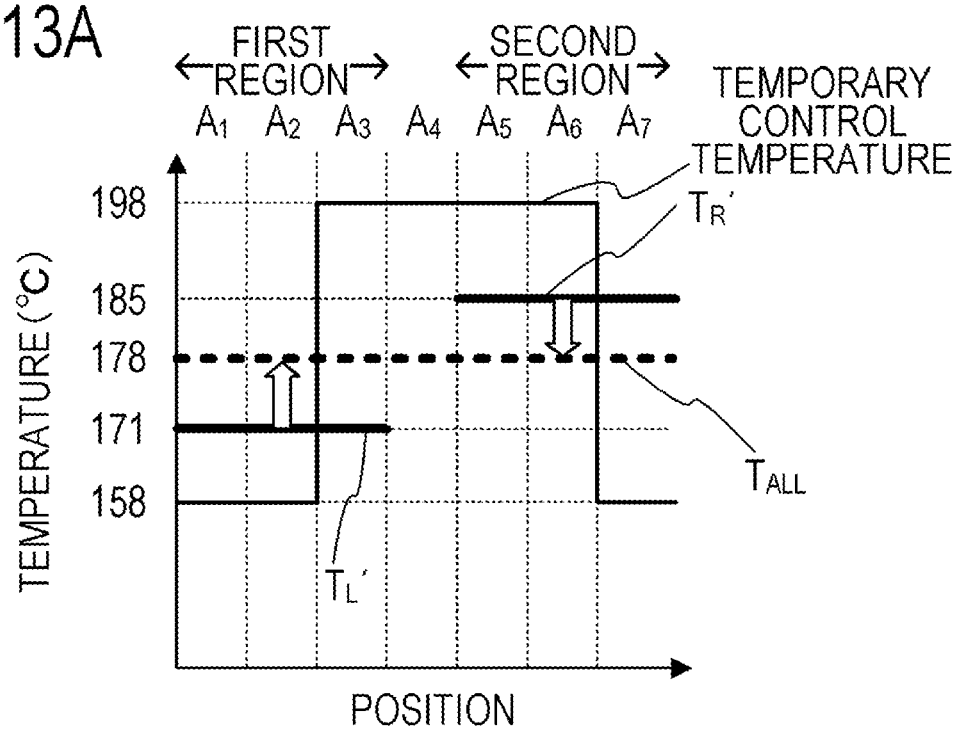
FIGS. 13A and 13B are diagrams showing a temporary control target temperature and a control target temperature of each heating region of the first embodiment.
Figure 13B:
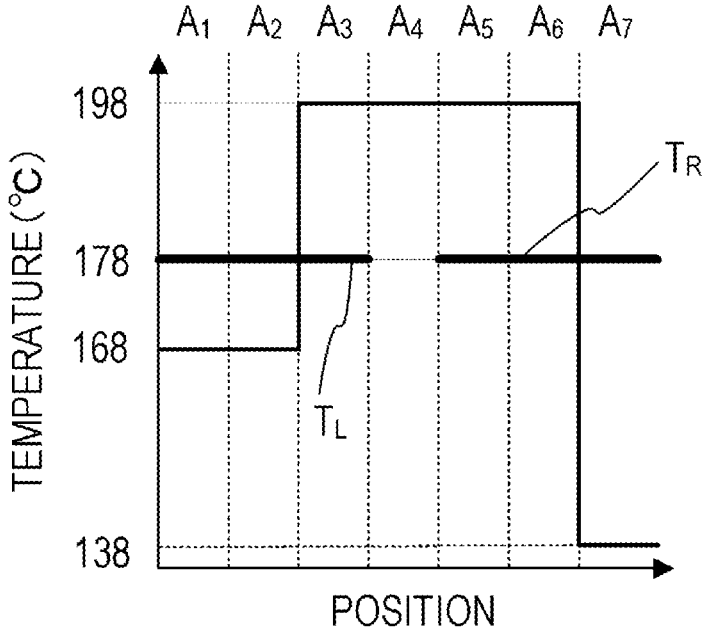

FIG. 13A is a diagram showing temporary control temperatures $TGT_i'$ of the heating regions $A_1$ to $A_7$ in the specific example, the temporary control temperature is set as indicated by a fine solid line in FIG. 13A, and the average values $T_L'$ and $T_R'$ of the temporary control temperatures in the first and second regions are indicated by thick solid lines. Further, in the specific example, the average value $T_{ALL}$ of the temporary control temperatures in all regions including the first region and the second region is indicated by a thick dot line in FIG. 13A. Here, the average values $T_L$ and $T_R$ of the control temperatures in the first and second regions are set to be the temperature $T_{ALL}$ indicated by the block solid-line arrows in FIG. 13A. Then, the finally determined control temperatures of the heating regions $A_1$ to $A_7$ are set as indicated by the fine solid lines in FIG. 13B.

Figure 14:
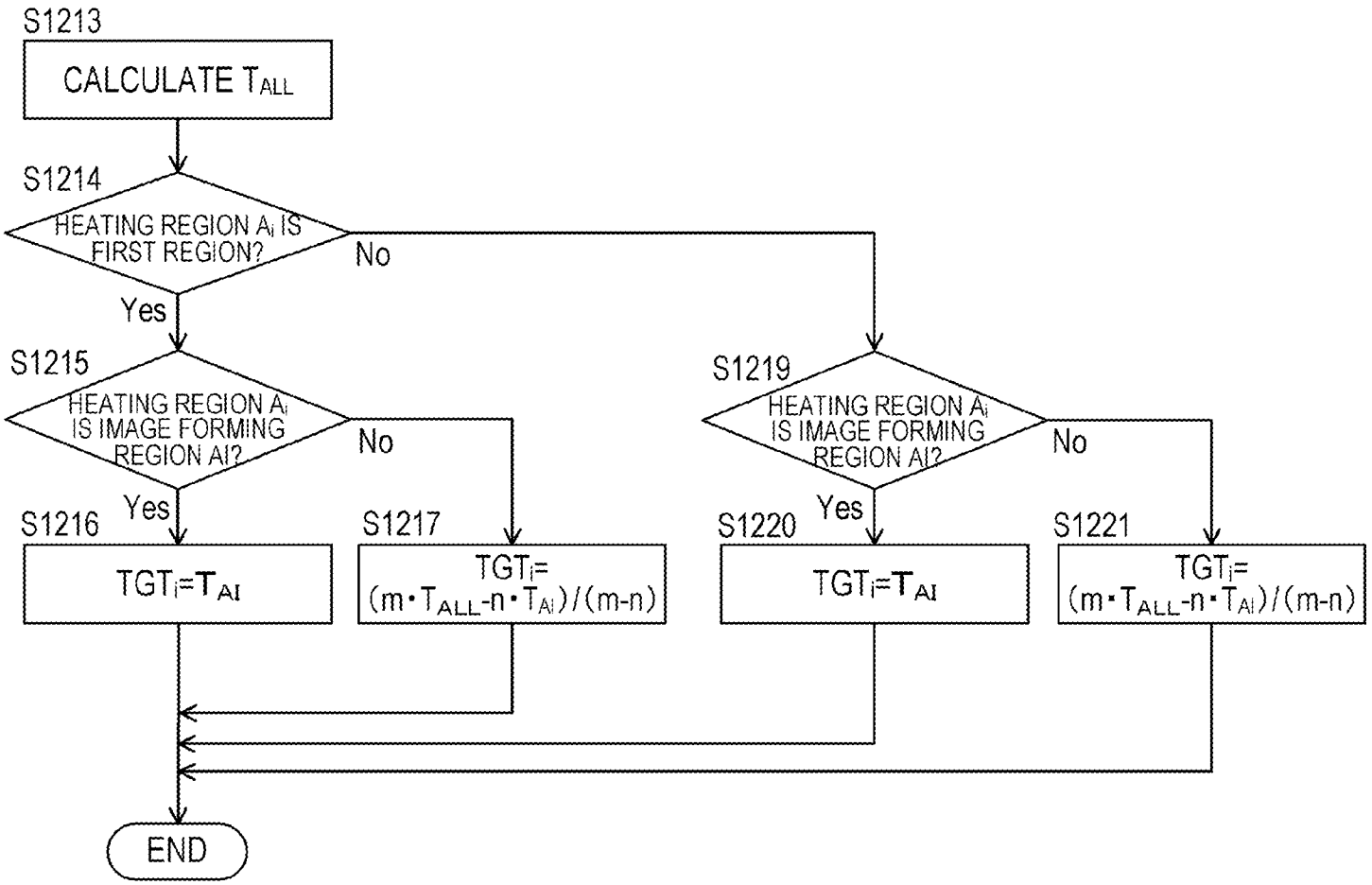
FIG. 14 is a flowchart for classifying the heating region and determining the control temperature in the first embodiment.

When the control temperature is determined in this way, the control temperature may be determined according to a flow in which the steps after S1013 in the flowchart of FIG. 9 are replaced with the steps after S1213 in the flowchart of FIG. 14.

By using any of the above-described methods, it is possible to suppress the occurrence of a lateral temperature difference in the longitudinal direction of the heater 300, suppress the occurrence of film breakage due to this lateral temperature difference, and achieve both the extended life of the fixing device and the power-saving property.

Modified Example of First Embodiment

In the present embodiment, the control temperature $TGT_i$ is set to have a laterally asymmetric temperature distribution as shown in FIG. 10B, but the control temperature $TGT_i$ may be set to be laterally symmetric.

For example, the flow after S1013 in the flowchart of FIG. 9 may be modified as described below. That is, a method may be used in which the temporary control temperatures of the heating regions located symmetrically about the center in the longitudinal direction of the heater 300 are compared with each other, and the larger temporary control temperature is set as the control temperature of both. Hereinafter, this method will be described with reference to specific examples.

Here, as a specific example, a method of setting the control temperature $TGT_i$ when a recording material and an image are present at the positions as shown in FIG. 6A will be described.

The temporary control temperatures of the heating regions $A_1$ to $A_7$ in the specific example are as indicated by the fine solid lines in FIG. 10A, and the temporary control temperatures TGT1' and TGT7', TGT2' and TGT6', and TGT3' and TGT5' of the heating regions located symmetrically are compared with each other. In the comparison between TGT1' and TGT7', TGT1'=TGT7', so the control temperature is set to TGT1=TGT7=158° C. In the comparison between TGT2' and TGT6', TGT2'<TGT6', so the control temperature is set to TGT2=TGT6=198° C. In the comparison between TGT3' and TGT5', TGT3'=TGT5', so the control temperature is set to TGT3 =TGT5=198° C.

Figure 15:
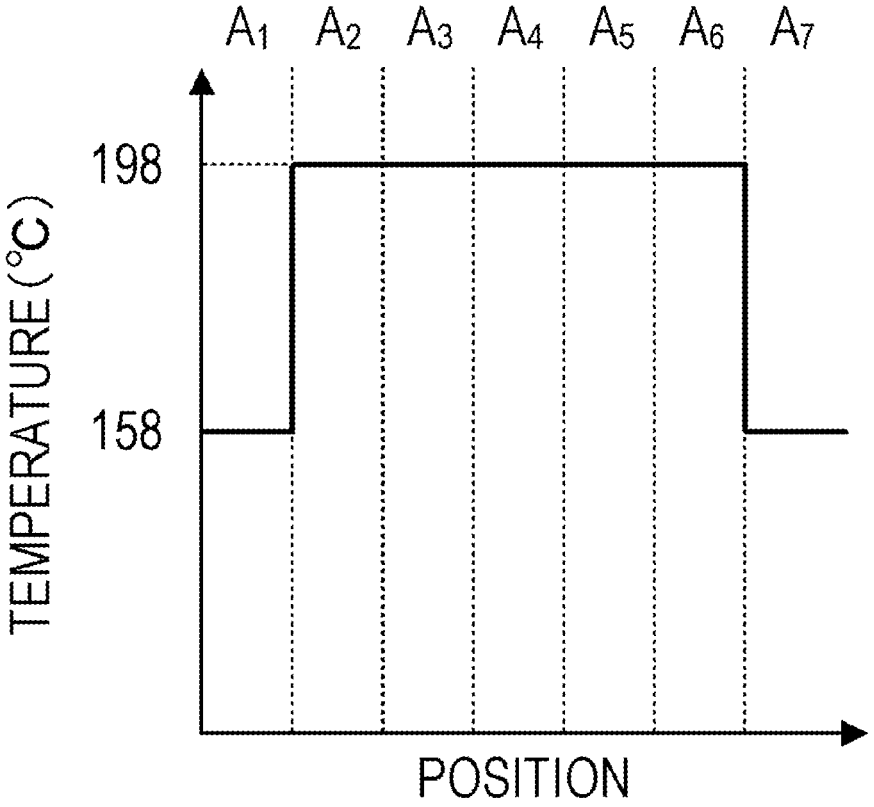
FIG. 15 is a diagram showing a control target temperature in a modified example of the first embodiment.

FIG. 15 is a diagram showing the finally determined control temperatures of the heating regions $A_1$ to $A_7$, and the control temperature is controlled so as to have a laterally symmetrical temperature distribution as shown in FIG. 15 using the above-described method.

Even if the above-described method is used, it is possible to suppress the occurrence of a lateral temperature difference in the longitudinal direction of the heater 300, suppress the occurrence of film breakage due to this lateral temperature difference, and achieve both the extended life of the fixing device and the power-saving property.

Second Embodiment

A second embodiment of the present invention will be described. The basic configuration and operation of the image forming apparatus and the image heating device of the second embodiment are the same as those of the first embodiment. Therefore, elements having the same or equivalent functions and configurations as in the first embodiment are denoted by the same reference numerals, and detailed description thereof will be omitted. Matters that are not particularly described in the second embodiment are the same as those in the first embodiment.

Figure 16A:
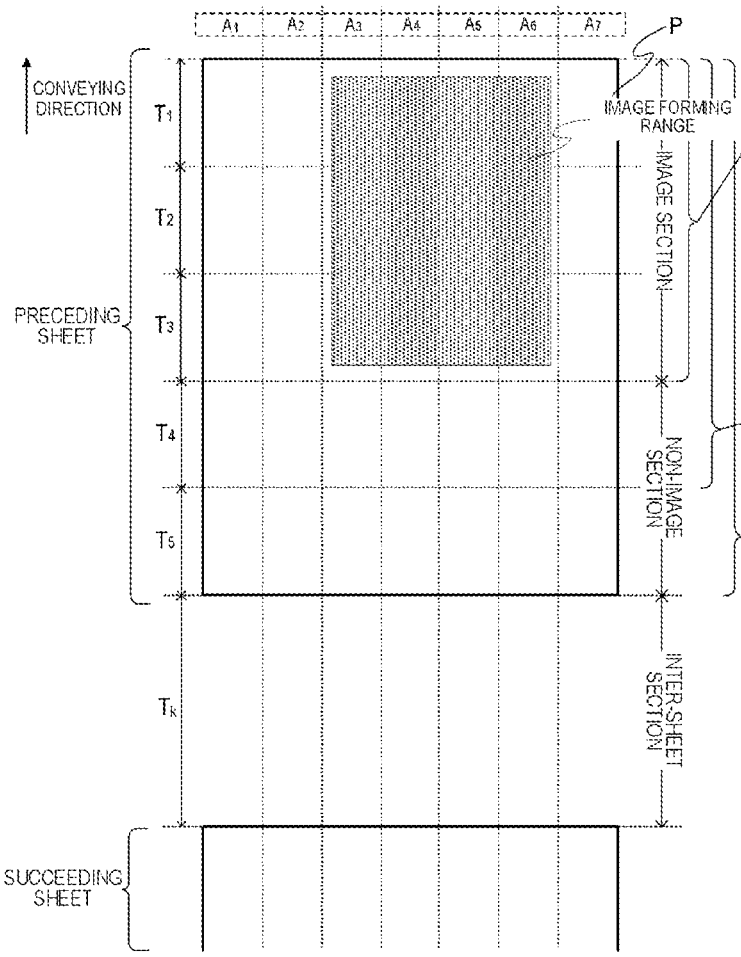

FIG. 16A is a diagram showing a specific example in which a recording material is divided into an image section and a non-image section in the conveying direction in the present embodiment. In the specific example, the recording material P has a LETTER size, and a section between a preceding sheet and a succeeding sheet, that is, a so-called an inter-sheet section is defined as a section $T_k$. Here, the image section refers to a section in the sections $T_1$ to $T_5$ in which at least one of the heating regions $A_1$ to $A_7$ is the image forming region AI, and in a specific example, the sections $T_1$, $T_2$, and $T_3$ are image sections. Further, in the sections $T_1$ to $T_5$, the section in which all the heating regions $A_1$ to $A_7$ are non-image forming regions AP is referred to as a non-image section, and in a specific example, the sections $T_4$ and $T_5$ are non-image sections. Further, assuming that the times required for the section $T_i$ and the inter-sheet section to pass through the fixing nip portion N are $t_i$ and $t_k$, respectively, $t_i$=0.24 s and $t_k$=0.52 s.

In the first embodiment, in the image section, the heat generation distribution is controlled so that the heat generation amounts on the left and right in the longitudinal direction of the heater 300 are equalized, and the damage of the fixing film is suppressed.

On the other hand, in the second embodiment, in the image section, the temperature is controlled by the control temperature $T_{AI}$ in the heating region classified as the image forming region AI, and the temperature is controlled by the control temperature $T_{AP}$ in the heating region classified as the non-image forming region AP. Therefore, if the image forming region in a certain image section is asymmetric in the longitudinal direction, the heat generation distribution in the longitudinal direction of the heater 300 in the image section may be laterally asymmetric. Therefore, due to this laterally asymmetrical heat generation distribution, the fixing film moves toward the side where the heat generation amount is large. Therefore, in the non-image section, the heat generation distribution of the heater 300 is controlled so that the fixing film moves in the direction opposite to the direction of the leaning movement of the fixing film occurred in the image section. In the present embodiment, the leaning movements of the fixing film in the image section and the non-image section are canceled in this way, and the damage of the fixing film due to the leaning movement is suppressed.

The method of setting the control temperature of the heater 300 in the present embodiment will be described with reference to the case where a recording material and an image are present at the positions shown in FIG. 16A as a specific example. In the present embodiment, first, the control temperature $TGT_i$ of the heating region $A_i$ in the image section is set. The control temperature $TGT_i$ in the image section is set on the basis of the classification of the heating region $A_i$. When the heating region $A_i$ is classified as the image forming region AI, $TGT_i=T_{AI}$. When the heating region $A_i$ is classified as the image forming region AP, $TGT_i=T_{AP}$.

Figure 17A:
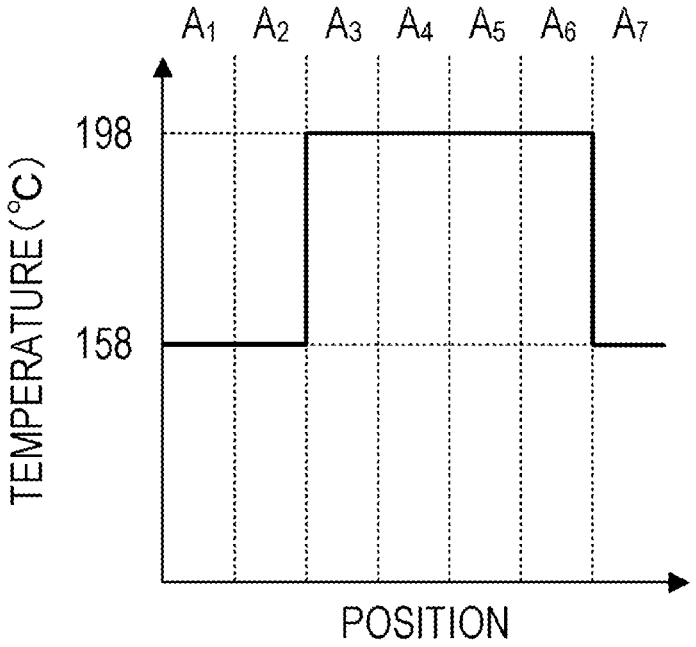
FIGS. 17A and 17B are diagrams showing a control temperature in an image section and a control temperature in a non-image section of the second embodiment.

In a specific example, the sections $T_1$ to $T_3$ correspond to the image section. In the image sections $T_1$ to $T_3$, the heating region $A_i$ is classified as shown in FIG. 16B. Therefore, the control temperature of the image section in the specific example is set as shown in FIG. 17A.

Figure 16C:
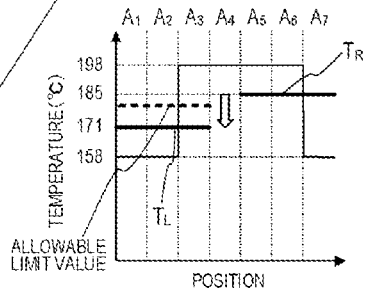

Next, in the image section, a section average value of the control temperature $TGT_i$ of each heating region $A_i$ is calculated. Here, the section average value is a value obtained by averaging the control temperature $TGT_i$ in each section for each heating region $A_i$. FIG. 16C is a diagram showing the section average value of the control temperature for each heating region $A_i$ in the image section, and the section average value of the control temperature is indicated by a fine solid line. Further, in FIG. 16C, the average value $T_L$ of the control temperature in the first region and the average value $T_R$ of the second region in the image section are indicated by thick solid lines. As a result, it can be understood that there is a lateral difference in the temperature distribution in the longitudinal direction of the heater 300 in the image section. In the present embodiment, the control temperature of the non-image section is determined so that the lateral difference of the temperature distribution in this image section is canceled in the non-image section, and $T_L$ and $T_R$ are equal in all sections $T_1$ to $T_5$. In the present embodiment, the control temperature in the non-image section is determined so that the average value $T_R$ of the control temperature in the second region approaches the average value $T_L$ in the first region.

Figure 16D:
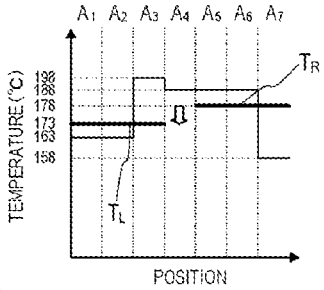
Figure 16E:
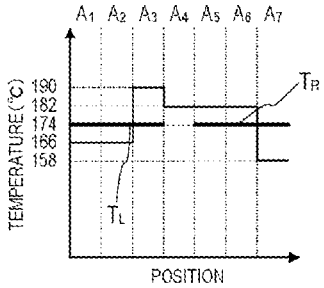

FIG. 16D is a diagram showing a section average value of the control temperature for each heating region $A_i$ in the sections $T_1$ to $T_4$ in a specific example, and FIG. 16E is a diagram showing a section average value of the control temperature for each heating region $A_i$ in the sections $T_1$ to $T_5$. In FIGS. 16D and 16E, the average value $T_L$ of the control temperature in the first region and the average value $T_R$ of the second region are indicated by thick solid lines. From these drawings, it can be understood that $T_R$ gradually approaches $T_L$ when the sheet passes through the non-image sections $T_4$ and $T_5$, and the lateral difference of the temperature distribution in the longitudinal direction of the heater 300 is eliminated.

Figure 17B:
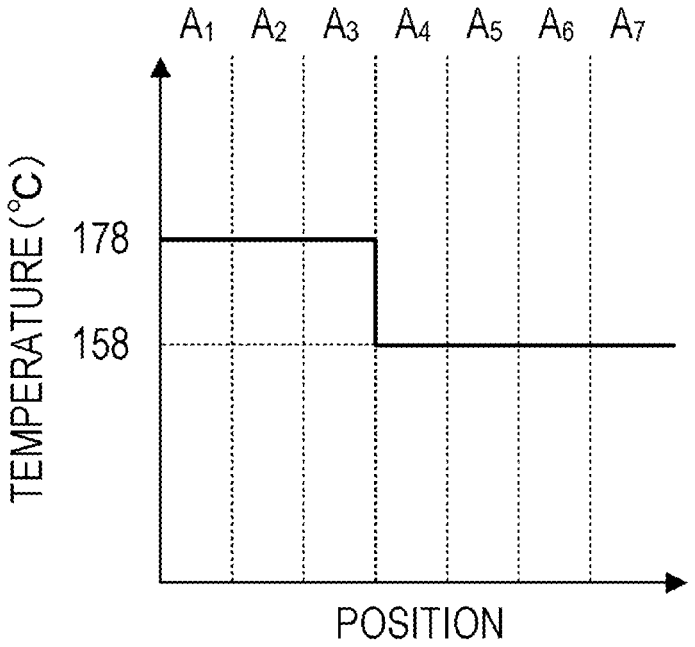

At this time, the control temperature of the non-image section is set as shown in FIG. 17B.

In the present embodiment, the control temperature is set so that the average value $T_L$ of the control temperatures in the first region and the average value $T_R$ of the second regions in the sections $T_1$ to $T_5$ are equal to each other, that is, $T_L=T_R$. However, it is not always necessary to set the control temperature so that $T_L=T_R$. For example, the control temperature in the non-image section may be set so that the average value $T_R$ of the control temperature in the first region is the temperature indicated by the thick dot line in FIG. 16C, that is, the allowable limit value of the lateral temperature difference.

By setting the control temperature as described above, the lateral temperature difference in the longitudinal direction of the heater 300 in the image section can be canceled in the non-image section. As a result, in the non-image section, the fixing film can be moved in the direction opposite to the leaning movement of the fixing film occurred in the image section. As a result, the leaning movements of the fixing film in the image section and the non-image section can be canceled, and the damage of the fixing film due to the leaning movement can be suppressed. Further, it is possible to obtain the same power-saving property as that in the first embodiment.

By the way, in the present embodiment, the control temperature in the non-image section is determined so that the average value $T_R$ of the control temperature of the second region in the sections $T_1$ to $T_5$ is equal to the average value $T_L$ of the control temperature of the first region in the image section. However, there is no limitation thereto. The control temperature may be determined so that the $T_L$ in the sections $T_1$ to $T_5$ is equal to the $T_R$ in the image section.

Further, the control temperature of the non-image section may be set so that the average values $T_L$ and $T_R$ of the control temperatures in the first and second regions in the sections $T_1$ to $T_5$ are the average value $T_{ALL}$ of the control temperatures in all regions including the first region and the second region in the image section.

Further, in the present embodiment, the heat generation distribution is controlled so that the section average values of the heat generation amounts on the left and right sides in the longitudinal direction of the heater in the image section and the non-image section are equalized when one recording material is printed. However, there is no limitation thereto. For example, a plurality of sheets being continuously printed may be grouped as one set, and the heat generation distribution may be controlled so that the section average values of the heat generation amounts on the left and right sides of the heater are equalized for each set.

Figure 18A:
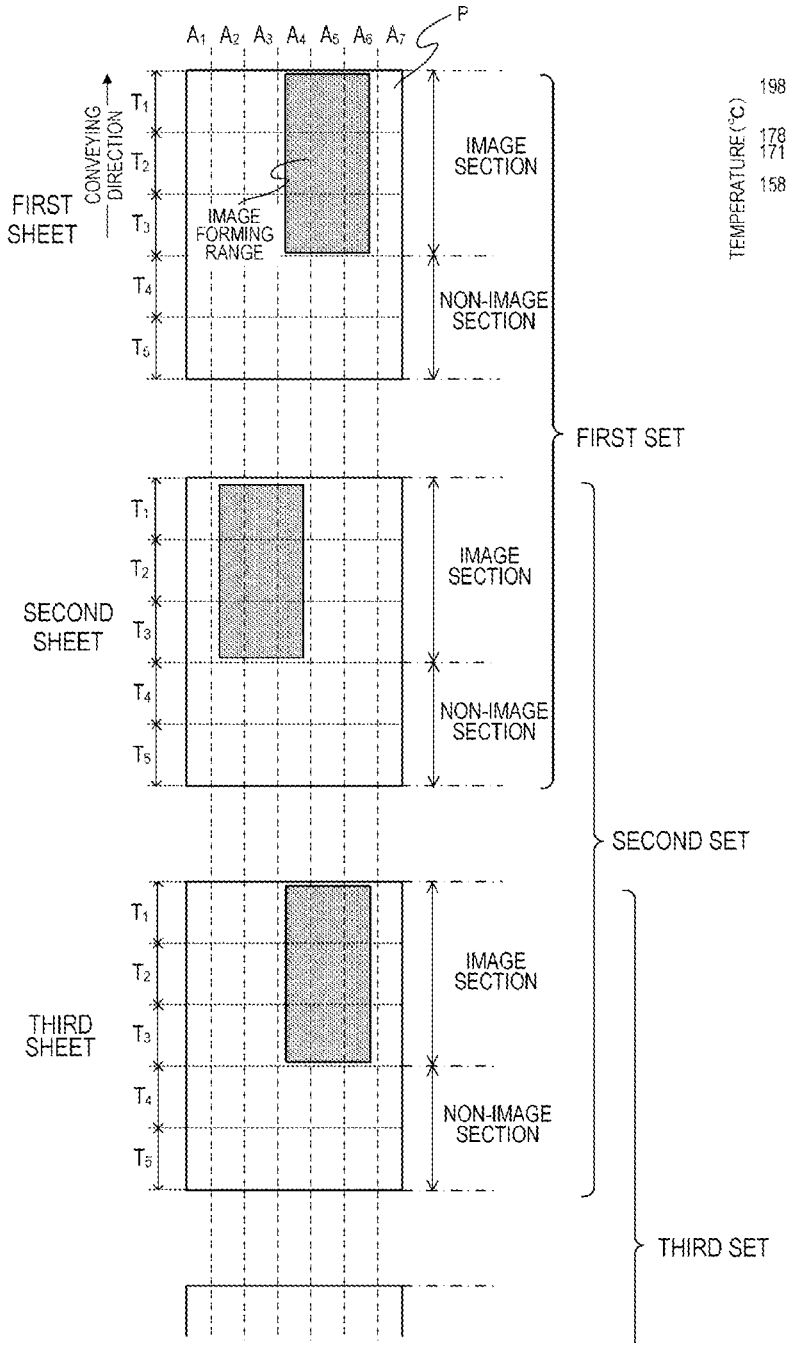
FIGS. 18A and 18B are diagrams showing a recording material and an image forming region during continuous printing in the second embodiment.
Figure 18B:
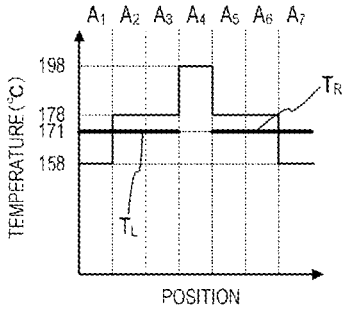

FIG. 18A shows three successive sheets when LETTER size recording materials are continuously printed (a plurality of images formed on a plurality of recording materials is continuously heated), and shows how laterally symmetrical images are printed continuously and alternately for each sheet. In this case, the average values $T_L$ and $T_R$ of the control temperatures of the first region and the second region in the image section in one set are calculated using two successive sheets as one set as shown in FIG. 18A. FIG. 18B is a diagram showing the section average values of the control temperatures in the image section when the first and second sheets are set as one set, the section average values are indicated by fine solid lines, and the average values $T_L$ and $T_R$ of the first region and the second region are indicated by thick solid lines. As shown in FIG. 18B, $T_L=T_R$, and there is no lateral temperature difference in the image section in one set. Therefore, in this case, in the non-image section, it is not necessary to cancel the lateral temperature difference in the image section. By considering the lateral temperature difference in the image sections of a plurality of sheets in this way, it is possible to suppress extra heating in the non-image section.

In the present embodiment, the lateral temperature difference in the longitudinal direction of the heater in the image section is canceled only in the non-image section. However, the lateral temperature difference in the image section may be canceled in a section including a non-image section and an inter-sheet section.

By using any of the above-described methods, the lateral temperature difference in the longitudinal direction of the heater 300 in the image section can be canceled in the non-image section, and the power-saving property can be obtained while suppressing the damage of the fixing film due to the leaning movement.

Third Embodiment

A third embodiment of the present invention will be described. The basic configuration and operation of the image forming apparatus and the image heating device of the first embodiment are the same as those of the first embodiment. Therefore, elements having the same or equivalent functions and configurations as in the first embodiment are denoted by the same reference numerals, and detailed description thereof will be omitted. Matters that are not particularly described in the third embodiment are the same as those in the first embodiment.

Figure 19A:
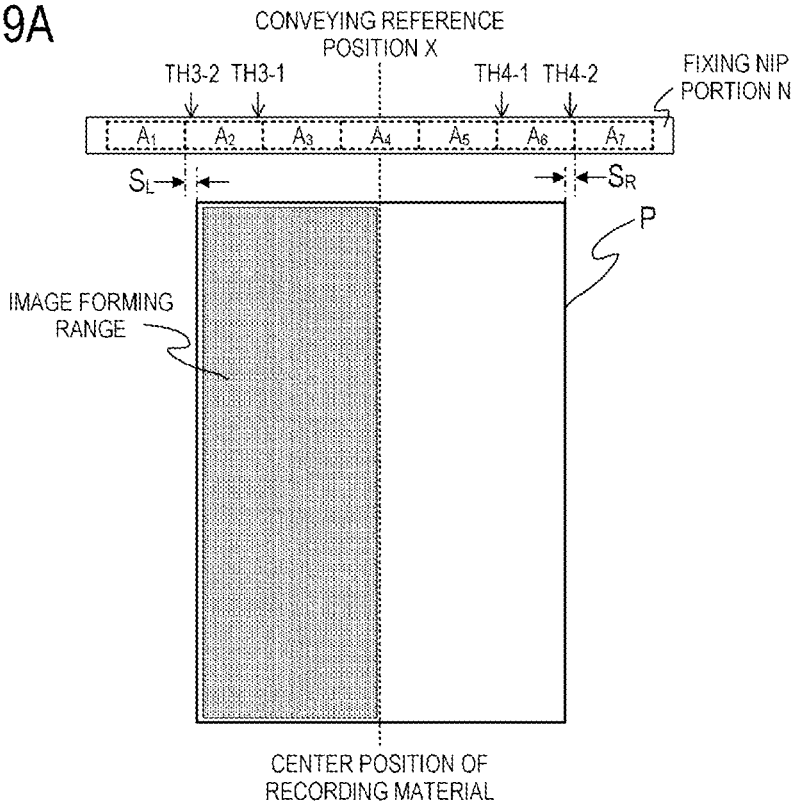
Figure 19C:
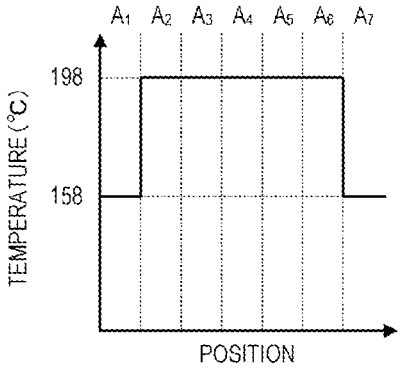

FIG. 19A is a diagram comparing the heating regions $A_1$ to $A_7$ in the present embodiment with the sheet width of the recording material P. In FIG. 19A, the recording material P is an A5 size sheet (148.5 mm×210 mm), and in the heating regions $A_2$ and $A_6$ corresponding to the end positions of the recording material, a sheet-passing portion and a non-sheet-passing portion $S_L$ and $S_R$ are present in one heat generation block. As shown in FIG. 19A, in the heating regions $A_2$ and $A_6$, thermistors TH3-1 and TH4-1 for temperature control and thermistors TH3-2 and TH4-2 for detecting the non-sheet-passing-portion temperature rise, respectively, are arranged as temperature detection units. Further, although the image is asymmetrically formed as shown in FIG. 19A, the control temperature of each heating region is set so as to have a symmetrical heat generation distribution as shown in FIG. 19B.

When the recording material and the image as shown in FIG. 19A are continuously printed using the image heating device as in the present embodiment, the non-sheet-passing-portion temperature rise occurs in the non-sheet-passing portions $S_L$ and $S_R$ in which the sheet does not pass. Therefore, a temperature difference occurs in the longitudinal direction even in one heating region. Further, although the heating region $A_2$ and the heating region $A_6$ have the same control target temperature, a toner image is formed in the heating region $A_2$. Therefore, for the heater to be maintained at the control temperature, the amount of electric power to be supplied to the heat generation block for heating the heating region $A_2$ needs to be larger than the amount of electric power to be supplied to the heat generation block for heating the heating region $A_6$ by the amount corresponding to the heat capacity of the toner. Therefore, a temperature rise of the non-sheet-passing portion $S_L$ in the heating region $A_2$ is larger than the temperature rise of the non-sheet-passing portion $S_R$ in the heating region $A_6$, and a lateral difference occurs in a non-sheet-passing-portion temperature rise.

Figure 20:
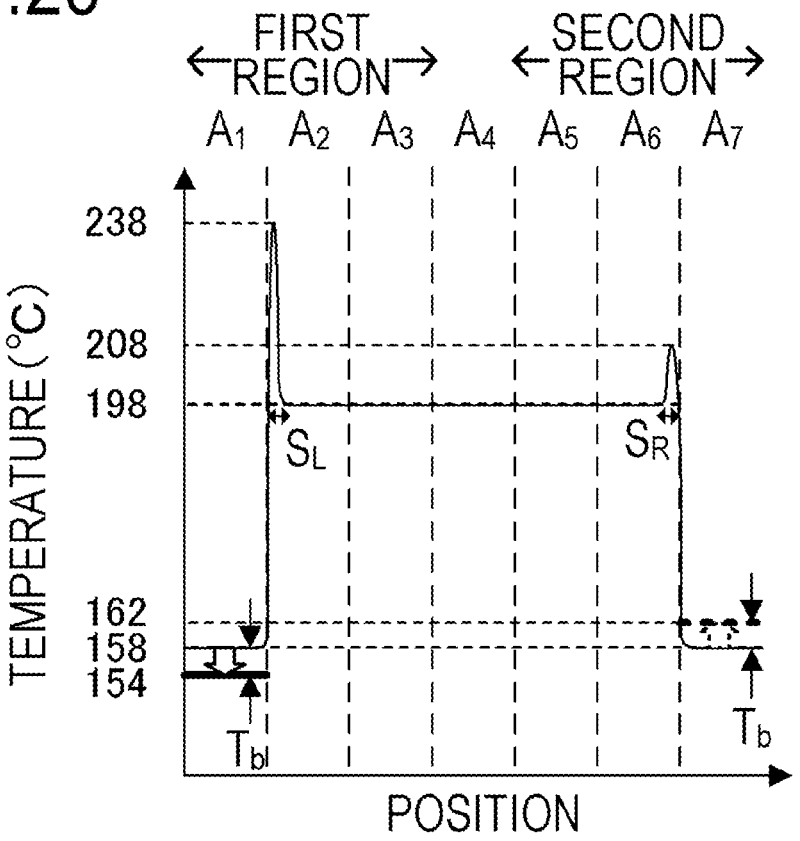
FIG. 20 is a diagram showing the heater temperature of the third embodiment.

FIG. 20 is a diagram showing the longitudinal temperature distribution of the heater at the time of printing 100 sheets in the above-mentioned continuous printing, and is indicated by a fine solid line. From FIG. 20, it can be understood that the temperature of the non-passing section $S_L$ is 30° C. higher than the temperature of the non-passing section $S_R$. In the present embodiment, the lateral difference in the non-sheet-passing-portion temperature rise is detected by the thermistors TH3-2 and TH4-2 for detecting the non-sheet-passing-portion temperature rise. Due to this lateral temperature difference, there is a possibility that the fixing film moves toward the side where the non-sheet-passing-portion temperature rise is large, the fixing film abuts against the regulation surface of the fixing flange, the fixing film ends are scraped, and the life of the image heating device is shortened.

In the present embodiment, in order to suppress the shortening of the life of the image heating device due to the lateral difference of the non-sheet-passing-portion temperature rise, the heater temperature of the heating region located outside the end position of the recording material is controlled so that the magnitude relationship of the temperature is opposite to the lateral temperature difference of the non-sheet-passing-portion temperature rise. The average values of the control temperatures in the first region and the second region are set to be equal to each other, and the leaning movement of the fixing film is suppressed.

Assuming that the lateral temperature difference due to the non-sheet-passing-portion temperature rise is $\Delta T_S$, the value of $\Delta T_S$ at the time of printing 100 sheets is $\Delta T_S$=30° C. as shown in FIG. 20. In the present embodiment, the control temperature $TGT_1$ in the heating region $A_1$ is set to a value lowered by $T_b$ as indicated by the thick solid line in FIG. 20 in order to eliminate the lateral temperature difference $\Delta T_S$ due to the non-sheet-passing-portion temperature rise. Here, $T_b$ is calculated by multiplying the ratio of the length $S_L$ or $S_R$ of the non-sheet-passing portion and the length $L_1$ of the heating region $A_1$ by the lateral temperature difference $\Delta T_S$ due to the non-sheet-passing-portion temperature rise as in the following equation.

$$T_b=\Delta T_S\times S_L/L_1 \quad \text{(Equation 5)}$$

In the present embodiment, since $\Delta T_s$=30° C., $S_L$=4.25 mm, and $L_1$=31.4 mm, $T_b$=4° C. is calculated. In the present embodiment, the length $S_L$ is calculated using the sheet width of the recording material P and the lengths of the heating regions $A_2$ to $A_6$.

As described above, by lowering the control temperature $TGT_1$ of the heating region $A_1$ located outside the end position of the recording material by $T_b$, the lateral temperature difference due to the non-sheet-passing-portion temperature rise can be eliminated, and the average values of the control temperatures in the first region and the second region can be made equal to each other. As a result, it is possible to suppress the leaning movement of the fixing film and extend the life of the image heating device.

In the present embodiment, the lateral temperature difference due to the non-sheet-passing-portion temperature rise is eliminated by lowering the control temperature $TGT_1$ in the heating region $A_1$ by $T_b$. However, instead of this, the control temperature $TGT_7$ in the heating region $A_7$ may be set to a value increased by $T_b$ as indicated by the thick dot line in FIG. 20. Even if the control temperature is set in this way, the average value of the control temperatures in the first region and the second region can be set to be equal to each other.

Fourth Embodiment

A fourth embodiment of the present invention will be described. The basic configuration and operation of the image forming apparatus and the image heating device of the third embodiment are the same as those of the first embodiment. Therefore, elements having the same or equivalent functions and configurations as in the first embodiment are denoted by the same reference numerals, and detailed description thereof will be omitted. Matters that are not particularly described in the fourth embodiment are the same as those in the first embodiment.

Figure 21A:
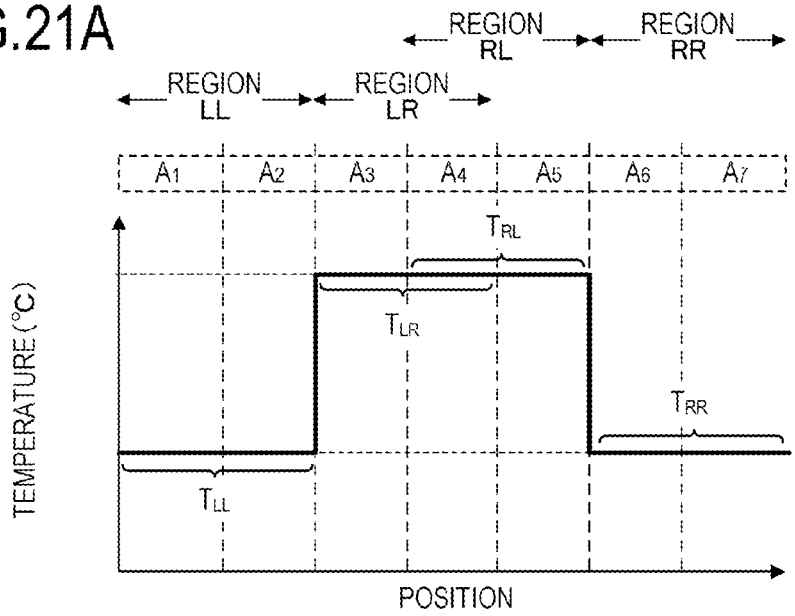
FIGS. 21A and 21B are diagrams for explaining the mechanism of generation of transversely moving force according to a fourth embodiment.

In the configuration as in the present embodiment, since the heat generation amount can be changed for each heat generation block, it is possible to create various heat generation distributions of the heater 300 in the longitudinal direction. FIG. 21A is a diagram schematically showing the heat generation distribution in the longitudinal direction of the heater 300, and as shown in FIG. 21A, the heat generation distribution in the longitudinal direction of the heater 300 may be modified to a heat generation distribution (hereinafter, a high center distribution) such that the heat generation amount in the central portion is large. In this way, when the heat generation distribution in the longitudinal direction of the heater 300 is modified to a high center distribution, a centering force is generated from both ends of the fixing film toward the center.

Figure 21B:
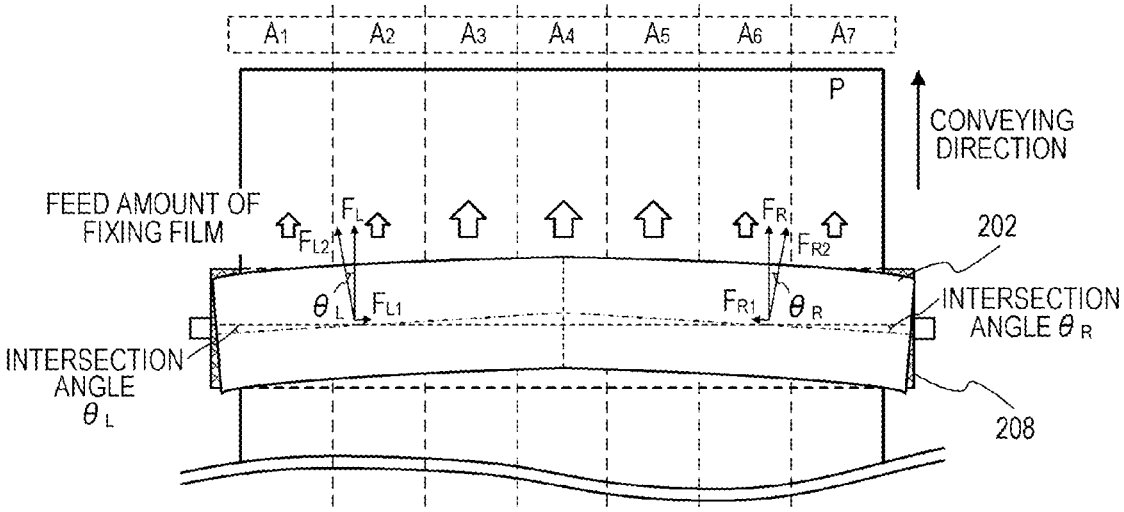

The cause of the centering force will be described with reference to FIGS. 21A and 21B. FIG. 21B is a diagram of the fixing device 200 viewed from a direction perpendicular to the plane parallel to the conveying direction of the recording material, and schematically shows a state in which a centering force acts on the fixing film 202. The high-center heat generation distribution of the heater 300 as shown in FIG. 21A causes a high-center temperature distribution in the longitudinal direction of the pressure roller 208. This high-center heat generation distribution causes a difference in the thermal expansion of the elastic layer of the pressure roller, and the outer diameter of the pressure roller in the heating regions $A_3$ to $A_5$ in the central portion where the temperature is high is larger than that of the heating regions $A_1$ and $A_5$ and $A_6$ and $A_7$ at the ends. Therefore, the feed amount at the center of the fixing film by the pressure roller is different from that at the ends as indicated by the block arrows in FIG. 21B, and the feed amount of the fixing film in the high-temperature portion is larger than the feed amount of the fixing film in the low-temperature portion. Due to this difference in the feed amount of the fixing film, the central portion of the fixing film is pushed toward the downstream side in the conveying direction than both ends, and the fixing film is deformed into a bow shape. That is, in an $A_1$-side half region from the center of the fixing film, an intersection angle $\theta_L$ is formed between the generatrix of the pressure roller 208 and the generatrix of the fixing film 202.

The fixing film 202 receives a force $F_L$ due to the rotation of the pressure roller 208 in the $A_1$-side half region. Therefore, due to the intersection angle $\theta_L$, the force $F_L$ is decomposed into the generatrix direction $F_{L1}=F_L \cdot \sin \theta_L$ of the fixing film 202 and the direction $F_{L2}=F_L \cdot \cos \theta_L$ orthogonal thereto. Since this force $F_{L1}$ is a force toward the center of the fixing film 202, leaning movement from the ends toward the center is generated in the fixing film 202. Similarly, in an $A_7$-side half region from the center of the fixing film, an intersection angle $\theta_R$ is formed between the generatrix of the pressure roller 208 and the generatrix of the fixing film 202, and the fixing film receives a force $F_R$ due to the rotation of the pressure roller 208. Therefore, even in this region, a transversely moving force toward the center of $F_{R1}=F_R \cdot \sin \theta_R$ is generated in the fixing film. The combined force $F_C=F_{L1}+F_{R1}$ of the forces $F_{L1}$ and $F_{R1}$ directed from both ends of the fixing film toward the center is the centering force, and the centering force is generated by the mechanism as described above.

If the fixing film is continuously subjected to a load due to such a centering force, wrinkles are generated in the central portion of the fixing film, causing damage to the fixing film, which may shorten the life of the image heating device.

Here, the present inventor has found that, when the temperature difference between the center and the end of the heater 300 in the longitudinal direction exceeds a certain temperature difference, the centering force of the fixing film 202 exceeds a breakage limit, wrinkles are generated in the central portion of the fixing film, and the fixing film is damaged. The results of an experiment carried out to examine the relationship between the centering force and the temperature difference between the center and the end of the heater 300 in the longitudinal direction and the threshold value of the centering force when the fixing film is damaged are described below.

The experiment was carried out according to the following procedure.

After confirming that the temperature of the fixing device is the same as the room temperature, continuous printing is performed for each set of 100 pages of LETTER size sheet. Since the fixing device can set various control temperatures $TGT_i$ (i=1 to 7) for each heat generation block, it is possible to set various temperature distributions in the longitudinal direction of the heater 300. Table 3 is a table showing the conditions of the control temperature of each heating region of the heater 300 in this experiment. In this experiment, as shown in Table 3, seven temperature distributions in the longitudinal direction of the heater 300 were set, and each set of sheets was continuously printed in each temperature distribution. During continuous printing, the control temperature is set to be constant regardless of whether the sheet is being passed or between sheets.

TABLE 3

| | Control temperature (° C.) | | | | | | |
|---|---|---|---|---|---|---|---|
| Condition | $TGT_1$ | $TGT_2$ | $TGT_3$ | $TGT_4$ | $TGT_5$ | $TGT_6$ | $TGT_7$ |
| 1 | 145 | 198 | 198 | 198 | 198 | 198 | 145 |
| 2 | 119 | 198 | 198 | 198 | 198 | 198 | 119 |
| 3 | 92 | 198 | 198 | 198 | 198 | 198 | 92 |
| 4 | 108 | 108 | 198 | 198 | 198 | 108 | 108 |
| 5 | 153 | 153 | 198 | 198 | 198 | 153 | 153 |
| 6 | 92 | 198 | 198 | 198 | 198 | 117 | 99 |
| 7 | 99 | 117 | 198 | 198 | 198 | 198 | 92 |

In this experiment, in order to calculate the centering force, the heating region is divided into four regions (region LL, region LR, region RL, region RR) as shown in FIG. 21A. The average temperature of the control temperature of the region LL as the first region is $T_{LL}$, the average temperature of the region RR as the second region is $T_{RR}$, and the average temperatures of the region LR and the region RL as the third region are $T_{LR}$ and $T_{RL}$, respectively.

When the heater has a high-center heat generation distribution as shown in FIG. 21A, a centering force $F_{L1}$ toward the center is generated in the fixing film due to the temperature difference of $T_{LR}-T_{LL}$, and a transversely moving force $F_{R1}$ toward the center is generated due to the temperature difference of $T_{RL}-T_{RR}$. The sum of these transversely moving forces is the centering force $F_C$ generated in the fixing film.

Here, the total temperature difference between the temperature difference $T_{LR}-T_{LL}$ and the temperature difference $T_{RL}-T_{RR}$ as the difference of the average temperature is referred to as a center-to-end temperature difference $T_C$, and the centering force $F_C$ is calculated using $T_C$. That is, the centering force $F_C$ can be calculated by replacing $\Delta T_{LR}$ with $T_C$ using a linear approximation equation obtained from the relationship between the transversely moving force of the fixing film and the lateral temperature difference $\Delta T_{LR}$ of the heater shown in FIG. 8C.

Figure 22:
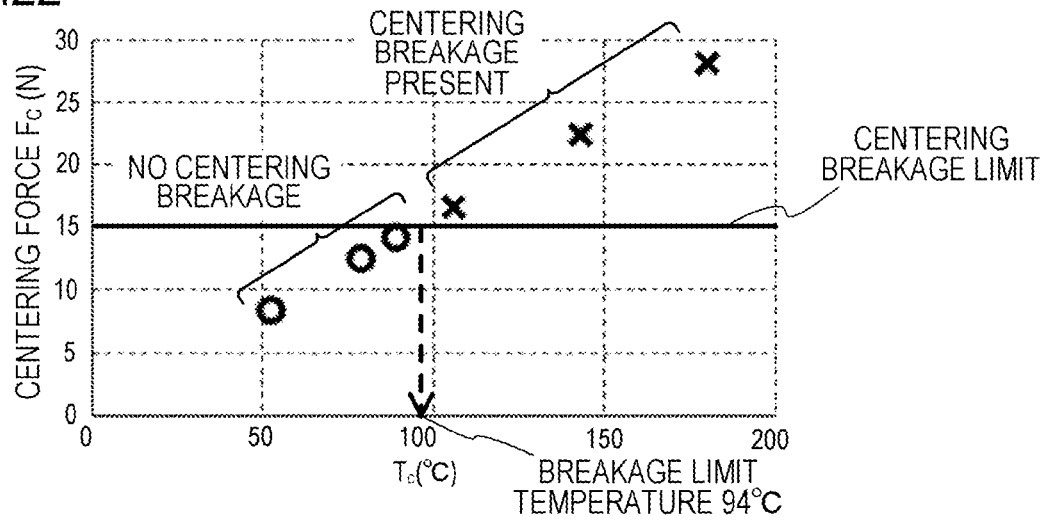
FIG. 22 is a diagram showing the experimental results in the fourth embodiment.

FIG. 22 is a diagram showing the relationship between the centering force $F_C$ and the center-to-end temperature difference $T_C$ when the sheet is passed under the conditions shown in Table 3, in which the condition in which the fixing film is damaged due to the centering force is plotted with X, and the condition in which the fixing film is not damaged is plotted with O.

As shown in FIG. 22, in this experiment, it was found that the fixing film was damaged when the force toward the center of the fixing film was increased, and the breakage limit was 15 N. Further, it was found that, since the center-to-end temperature difference when the centering force exceeds 15 N is $T_C$=94° C., the center-to-end temperature difference $T_C$ needs to be smaller than 94° C. in order to suppress the damage of the fixing film due to the centering force.

In the present embodiment, as described above, the control temperature is determined so that the center-to-end temperature difference $T_C$ is lower than the breakage limit temperature of 94° C. as a predetermined threshold value. In this way, the damage of the fixing film due to the centering force is suppressed while maintaining the power-saving property and the life of the fixing device is extended as much as possible.

A method of setting the control temperature $TGT_i$ of each heat generation block in the present embodiment will be described.

Figures 23A, 23B:
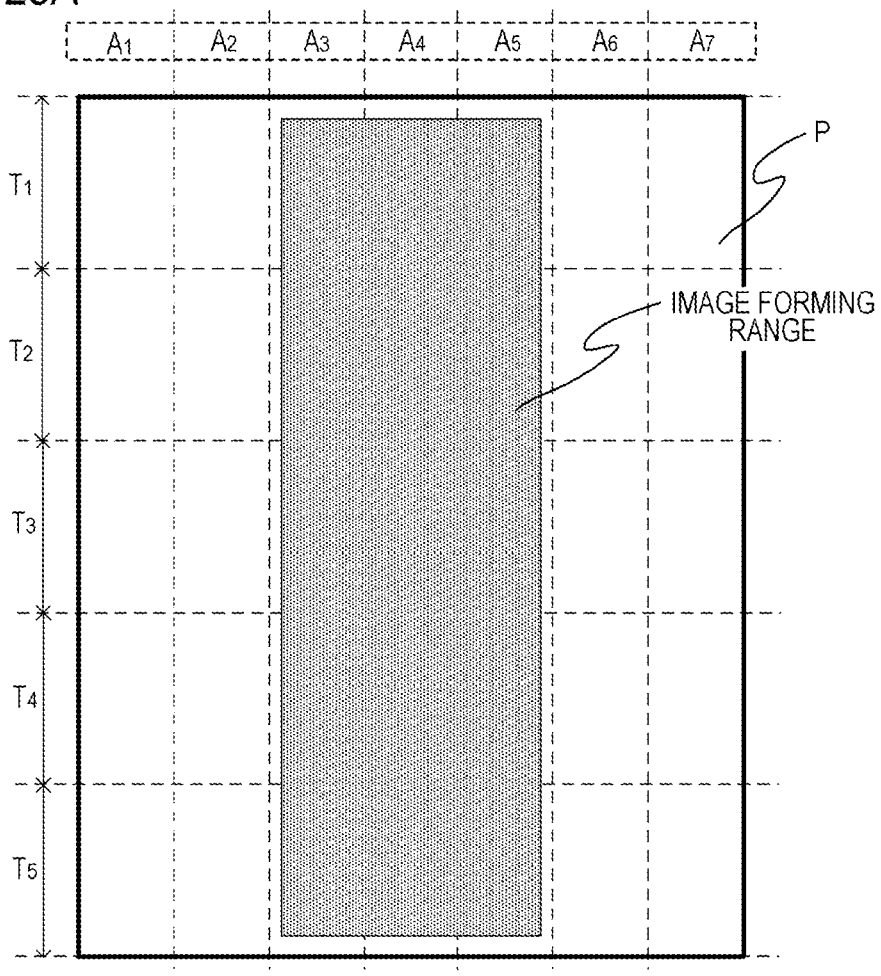
FIGS. 23A and 23B are specific examples related to the classification of the heating region of the fourth embodiment.

In this example, a method of setting the control temperature $TGT_i$ in the sections $T_1$ to $T_5$ when a recording material and an image are present at the positions as shown in FIG. 23A will be described as an example.

In the present embodiment, first, the control temperature $TGT_i$ of the heating region $A_i$ corresponding to the image forming region is set. FIG. 23B is a diagram showing the results of classification of the heating region $A_i$ on the basis of the image information. In the present embodiment, the control temperature $TGT_i$ of the heating region $A_i$ classified as the image forming region AI is set to $TGT_i=T_{AI}$.

On the other hand, the control temperature $TGT_i$ of the heating region $A_i$ classified as the non-image forming region AP is set such that the center-to-end temperature difference is set to $T_C$=84° C. as a value with a margin of 10° C. with respect to the above-mentioned damage limit temperature. The center-to-end temperature difference when determining the control temperature in the non-image forming region is not limited to $T_C$=84° C. Since the breakage limit temperature differs depending on the strength of the fixing film, the center-to-end temperature difference should be appropriately set according to the breakage limit temperature.

Figure 24:
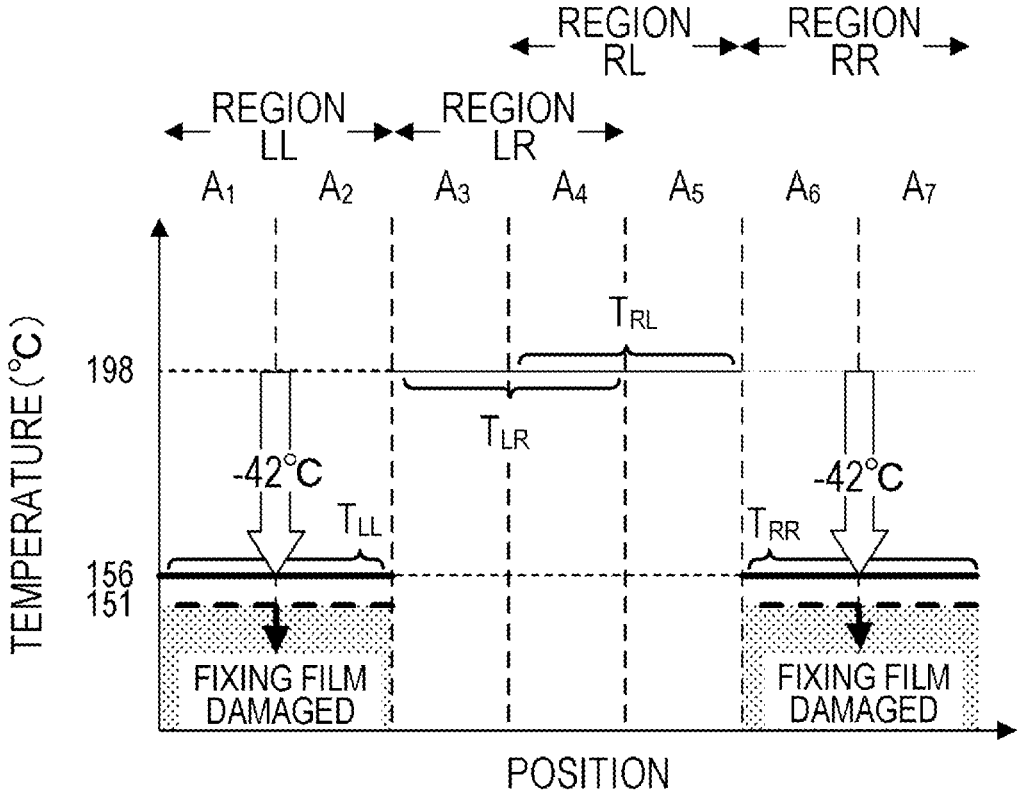
FIG. 24 is a diagram showing a control target temperature of the fourth embodiment.

FIG. 24 is a diagram showing the control temperatures of the heating regions $A_1$ to $A_7$ finally determined in the present embodiment, in which the control temperature in the image forming region is indicated by a fine solid line and the control temperature in the non-image forming region is indicated by a thick solid line. As shown in FIG. 24, the control temperature in the non-image forming region is set so that the temperature difference $T_{LR}-T_{LL}$ between the region LR and the region LL and the temperature difference $T_{RL}-T_{RR}$ between the region RL and the region RR are 42° C. In FIG. 24, when the control temperature of the non-image forming region is set to a value equal to or less than the value indicated by the thick dot line, the center-to-end temperature difference TC exceeds the breakage limit temperature, and damage occurs due to the centering force of the fixing film.

When the control temperature in the non-image forming region is set as described above, the power-saving property can be achieved by lowering the temperature in the non-image forming region as much as possible while suppressing the shortening of the life of the image heating device due to the damage of the fixing film due to the center-to-end temperature difference of the fixing film.

Configurations of the respective embodiments and the modified example described above-described can be mutually combined to the greatest extent feasible.

The present invention is not limited to the above-described embodiment, and may be changed and modified in various manners without departing from the spirit and scope of the present invention. Therefore, the following claims are attached to disclose the scope of the present invention.

According to the present invention, it is possible to achieve both power-saving and long life in the image heating device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating device comprising:

a heater having a plurality of heating elements arranged in a longitudinal direction of the heater orthogonal to a conveying direction of a recording material;

an acquisition portion that acquires information of an image to be formed on the recording material, and a control portion that independently controls electric power supplied to each of the plurality of heating elements so that each of a plurality of heating regions heated by the plurality of heating elements is maintained at a control target temperature, wherein the image formed on the recording material is heated by the heat of the heater, the control portion sets respective control target temperatures of image heating regions through which the image passes in accordance with the acquired information, the control portion sets respective preset temperatures of non-image heating regions through which the image does not pass, that are located closer to one end side than a central heating region in the longitudinal direction, and sets respective preset temperatures of non-image heating regions through which the image does not pass, that are located closer to the other end side than the central heating region in the longitudinal direction, and the control portion corrects the respective preset temperatures to the control target temperatures such that a difference between a first average temperature, which is an average value of the respective preset temperatures in a predetermined number of heating regions located closer to the one end side, and a second average temperature, which is an average value of the respective preset temperatures in a predetermined number of heating regions located closer to the other end side, is within a predetermined temperature range.

2. The image heating device according to claim 1, wherein the control portion corrects the respective preset temperatures such that the first average temperature and the second average temperature are the same value.

3. The image heating device according to claim 1, further comprising:

a plurality of temperature detection units that detect a temperature of each of the plurality of heating elements, wherein the control portion independently controls the electric power supplied to each of the plurality of heating elements so that each of temperatures detected by the plurality of temperature detection units is maintained at the control target temperature.

4. The image heating device according to claim 1, further comprising:

a tubular film; and a pressure member that is rotated and makes contact with an outer surface of the film to form a nip portion at which a recording material is conveyed between the outer surface and the pressure member, wherein the heater is provided in an inner space of the film, and the nip portion is formed by the heater and the pressure member through the film.

5. An image forming apparatus comprising:

an image forming portion that forms an image on a recording material; and a fixing portion that fixes the image formed on the recording material to the recording material, wherein the fixing portion is the image heating device according to claim 1.

6. An image heating device comprising:

a heater having a plurality of heating elements arranged in a direction orthogonal to a conveying direction of a recording material;

a control portion that controls temperatures of a plurality of heating regions heated by the plurality of heating elements individually by controlling electric power to be supplied to the plurality of heating elements individually; and an acquisition portion that acquires information on an image to be formed on the recording material, wherein the image formed on the recording material is heated by the heat of the heater, and the control portion controls the supply of electric power to the plurality of heating elements such that:

when an average value of control target temperatures of heating regions included in a first region located closer to one end side than a central heating region in a direction orthogonal to the conveying direction among the plurality of heating regions is a first average temperature, an average value of control target temperatures of heating regions included in a second region located closer to the other end side than the central heating region is a second average temperature, and an average value of control target temperatures of heating regions included in a third region between the first region and the second region, including at least the central heating region is a third average temperature, relationships that the third average temperature is equal to or higher than the first average temperature and the third average temperature is equal to or higher than the second average temperature are satisfied, and a sum of a difference between the first average temperature and the third average temperature and a difference between the second average temperature and the third average temperature is smaller than a predetermined threshold value.

7. The image heating device according to claim 6, further comprising:

a tubular film; and a pressure member that is rotated and makes contact with an outer surface of the film to form a nip portion at which a recording material is conveyed between the outer surface and the pressure member, wherein the heater is provided in an inner space of the film, the nip portion is formed by the heater and the pressure member through the film, and the predetermined threshold value is a value in which a force which is generated due to a temperature difference in a direction orthogonal to the conveying direction of the plurality of heating regions and acts on the film in a direction orthogonal to the conveying direction is suppressed to be a predetermined allowable value.

8. An image forming apparatus comprising:

an image forming portion that forms an image on a recording material;

a fixing portion that fixes the image formed on the recording material to the recording material, the fixing portion includes a heater for heating the image in which a plurality of heating elements are arranged in a longitudinal direction of the heater orthogonal to a conveying direction of a recording material; and a control portion that independently controls electric power supplied to each of the plurality of heating elements so that each of a plurality of heating regions heated by the plurality of heating elements is maintained at a control target temperature, wherein the control portion sets respective control target temperatures of image heating regions through which the image passes higher than respective control target temperatures of non-image heating regions through which the image does not pass, and in a case where a number of the non-image heating regions located closer to one end side in the longitudinal direction is larger than a number of the non-image heating regions located closer to the other end side in the longitudinal direction, the control portion sets the respective control target temperatures of the non-image heating regions located closer to the one end side higher than the respective control target temperatures of the non-image heating regions located closer to the other end side.

9. The image forming apparatus according to claim 8, further comprising an acquisition portion that acquires information of the image to be formed on the recording material, wherein the control portion sets the respective control target temperatures of the image heating regions in accordance with the information.

10. The image forming apparatus according to claim 8, wherein the fixing portion includes a plurality of temperature detection elements that detect each of the plurality of heating elements, and wherein the control portion independently controls the electric power supplied to each of the plurality of heating elements so that each of temperatures detected by the plurality of temperature detection elements is maintained at the control target temperature.

11. The image forming apparatus according to claim 10, wherein the heater includes a substrate, and wherein the plurality of heating elements are provided on the substrate.

12. The image forming apparatus according to claim 11, wherein the fixing portion includes a tubular film and a roller in contact with an outer surface of the film, wherein the heater is located in an inner space of the film, and wherein a nip portion through which the recording material passes is formed between the film and the roller by sandwiching the film between the heater and the roller.

* * * * *